US010632041B2

(12) United States Patent
Rubin

(10) Patent No.: US 10,632,041 B2
(45) Date of Patent: Apr. 28, 2020

(54) LOW INTENSITY VIBRATION DEVICE DELIVERING MECHANICAL SIGNALS TO BIOLOGICAL SYSTEMS

(71) Applicant: Marodyne Medical, LLC, Tampa, FL (US)

(72) Inventor: Clinton Rubin, Port Jefferson, NY (US)

(73) Assignee: Marodyne Medical, LLC, Tampa, FL (US)

( * ) Notice: Subject to any disclaimer, the term of this patent is extended or adjusted under 35 U.S.C. 154(b) by 1088 days.

(21) Appl. No.: 14/761,813

(22) PCT Filed: Jan. 22, 2014

(86) PCT No.: PCT/US2014/000014
§ 371 (c)(1),
(2) Date: Jul. 17, 2015

(87) PCT Pub. No.: WO2014/113216
PCT Pub. Date: Jul. 24, 2014

(65) Prior Publication Data

US 2015/0359702 A1 Dec. 17, 2015

Related U.S. Application Data

(60) Provisional application No. 61/754,352, filed on Jan. 18, 2013.

(51) Int. Cl.
*A61H 23/02* (2006.01)
*A61H 5/00* (2006.01)

(52) U.S. Cl.
CPC ..... *A61H 23/0218* (2013.01); *A61H 5/005* (2013.01); *A61H 2201/0119* (2013.01); *A61H 2201/164* (2013.01); *A61H 2201/5084* (2013.01)

(58) Field of Classification Search
CPC ..... A61H 23/0218; A61H 5/005; A61H 2201/164; A61H 2201/0119;
(Continued)

(56) References Cited

U.S. PATENT DOCUMENTS 6,068,280 A * 5/2000 Torres ..... A61G 5/045 180/328
2005/0073141 A1* 4/2005 Baird ..... B60P 1/56 280/766.1

(Continued)

FOREIGN PATENT DOCUMENTS

WO 2011/096008 A1 8/2011

OTHER PUBLICATIONS

Australian Examination Report No. 1 dated Sep. 13, 2017, corresponding to Australian Application No. 2014207857; 4 pages.

(Continued)

*Primary Examiner* — Sundhara M Ganesan
*Assistant Examiner* — Shila Jalalzadeh Abyaneh
(74) *Attorney, Agent, or Firm* — Carter, DeLuca & Farrell LLP; George Likourezos

(57) ABSTRACT

A vibration device 10 includes top plate assembly 12 defining cavity 27 therein that is configured and dimensioned to receive actuator plate 19 such that the actuator plate 19 is in direct contact with the top plate assembly 12. The actuator plate 19 transmits thereby a vibration signal represented by an oscillating vibratory force to the top plate assembly 12 to operate the oscillating vibration device. Vibration device 10 further includes base plate assembly 14 for the vibration device 10. The top plate assembly 12 is configured and dimensioned to be mounted on the base plate assembly 14. The base plate assembly 14 includes actuator mounting assembly 20 that is configured to receive actuator 50 generating a vibration signal represented by an oscillating (Continued)

vibratory force. A method of operating the oscillating vibration device 10 includes transmitting a vibration signal represented by an oscillating vibratory force to foot plate assembly 12.

4 Claims, 13 Drawing Sheets

(58) Field of Classification Search
CPC .. A61H 2201/5084; A61H 1/00; A61H 23/00; A61H 1/005; A61H 1/003; A61H 39/00; A61H 2201/0165; A61H 1/001; A61H 23/02; A61H 2023/0209; A61H 2023/0227; A61H 23/0236; A61H 23/0245; A61H 23/0254; A61H 23/0263; A61H 2023/0272; A61H 2023/0281; A61H 2023/029; A61H 23/04; A61H 2201/1678; A63B 21/00; A63B 21/18; A63B 2220/64; A63B 21/00196
See application file for complete search history.

(56) References Cited

U.S. PATENT DOCUMENTS

| | | | | |
|---|---|---|---|---|
| 2005/0131319 | A1* | 6/2005 | der Meer | A61H 1/005 601/49 |
| 2008/0009776 | A1* | 1/2008 | Trandafir | A61H 1/005 601/53 |
| 2008/0097256 | A1* | 4/2008 | Torres | A61G 5/045 601/24 |
| 2008/0200850 | A1 | 8/2008 | Casalino | |
| 2009/0091410 | A1* | 4/2009 | Leung | A61H 1/005 335/231 |
| 2012/0296244 | A1* | 11/2012 | Ceoldo | A61H 1/005 601/46 |

OTHER PUBLICATIONS

International Search Report issued in corresponding application No. PCT/US2014/000014 dated Nov. 5, 2014.
PCT International Preliminary Report on Patentability and Written Opinion of the International Searching Authority for PCT/US2014/000014 dated Jul. 30, 2015.

* cited by examiner

LOW INTENSITY VIBRATION DEVICE DELIVERING MECHANICAL SIGNALS TO BIOLOGICAL SYSTEMS

CROSS-REFERENCE TO RELATED APPLICATIONS

This application is a National Stage Application of International Application No. PCT/US2014/00014, filed Jan. 22, 2014, which claims the benefit of, and priority to, U.S. Provisional Patent Application Ser. No. 61/754,352 filed on Jan. 18, 2013, the entire contents of each of which is hereby incorporated by reference herein.

BACKGROUND

1. Technical Field

The present disclosure relates to oscillatory plates for therapeutic protocols. More particularly, the present disclosure relates to low intensity oscillatory plates for cell proliferation.

2. Background of Related Art

Over the past 25 years, Low Intensity Vibration (LIV) has been developed in University Laboratories supported by government funding agencies, including the National Institutes of Health (NIH), the National Aeronautics and Space Administration (NASA), and the US Army, to provide a non-drug based intervention to safely and effectively build bone and connective tissues, improve postural stability, and, by stimulating the differentiation and proliferation of adult stem cells, accelerate and augment the recovery of bone and connective tissues from injury or disease.

Low intensity vibrations are a type of low-magnitude mechanical signal delivered by an oscillating platform of a vibration device. Scientists have long known that the basic activities and actions of cells are governed by complex interactions of biological, chemical, and physical signals. The LIV signal works at the level of contributing to the physical environment, and therefore allowing a way to non-invasively, and non-pharmaceutically, control the actions of the cells, including biasing differentiation and proliferation of stem cells.

The basis for how cells can sense and respond to such small mechanical signals lies in that cells form networks, which are capable of acting as integrated units to transduce various stimuli, such as mechanical loading, into coordinated tissue responses. Not surprisingly, this process is extremely complex, both physically and biologically, but occurs continuously as a part of daily living and is essential to the regulation, repair, growth and development of all physiologic systems.

In diseases such as osteoporosis, where the reduction in the normal functional challenges to the skeleton occur with aging is considered a key etiologic factor in bone thinning, vibration can be effective because it in essence recapitulates this mechanical component and stimulates the body's natural responses to the biophysical stimuli to regenerate and repair tissues, such as building new bone. When considering the role of sarcopenia (muscle loss) and the diminished mechanical loading in aged or infirm, the decay of muscle-based signal components would also diminish mechanically-based regulatory signals and contribute as much to the decline of the musculoskeletal system as a reduction in the age-related decline in the sensitivity of cells to mechanical signals.

SUMMARY

The present disclosure relates to a device that includes a top plate assembly defining an outer surface for placement thereof a subject. A base plate assembly is mounted to the top plate assembly in a manner which enables the top plate assembly to move relative to the base plate assembly. At least one energy recovery member, e. g., a spring, is mounted to the top plate assembly and the base plate assembly. An actuator mounting assembly is configured and dimensioned for receiving an actuator support housing. An actuator plate is mounted to the actuator support housing and contacts an inner surface of the top plate assembly. An actuator is housed within the actuator support housing and is configured for transmitting a vibration signal represented by an oscillatory vibratory force to the top plate assembly via the actuator plate. The actuator converts an electrical input signal to the oscillating vibratory force. The Device also includes a controller and an accelerometer having three degrees of freedom at an origin and is in operative communication with the controller for detecting movement of the top plate assembly and determining whether the top plate assembly is level with respect to the base plate assembly. The accelerometer further detects acceleration of the top plate assembly and transmits acceleration data to the controller.

The controller determines based on the acceleration data whether to increase, decrease or maintain the electrical signal delivered to the actuator in order to maintain the acceleration of the top plate assembly at a predetermined average acceleration. In one embodiment, the controller maintains the acceleration of the top plate assembly at a predetermined average acceleration of 0.3 g peak-to-peak.

The present disclosure relates also to a base plate assembly for an oscillating vibration device that includes an actuator mounting assembly configured to receive an actuator generating a low intensity vibration signal. The actuator mounting assembly includes an actuator support housing and a mounting cup configured and dimensioned for receiving therein the actuator support housing. The base plate assembly defines a center therein. The actuator mounting assembly is positioned in the base plate assembly at a position offset with respect to the center defined by the base plate assembly. The position of the actuator mounting assembly is generally aligned with the center of pressure of the feet of a user of the oscillating vibration device.

In one exemplary embodiment, the base plate assembly may further include an actuator mounted within the mounting cup and an actuator plate mounted on the actuator support housing. The actuator is configured and dimensioned for transmitting a vibration signal represented by an oscillating vibratory force to the actuator plate. The actuator converts an electrical input signal to the oscillating vibratory force.

In still another exemplary embodiment, the base plate assembly may further include a foot assembly configured for operative communication with a foot plate assembly of the oscillating vibration device. The foot plate assembly defines a baseline level with respect to a surface upon which the base plate assembly is positioned. The foot assembly includes at least one foot assembly actuator in signal communication with a controller such that upon the controller receiving a signal indicating that the foot plate assembly is not aligned with the baseline level, the controller transmits a signal to the at least one foot assembly actuator to adjust the position of the foot plate assembly to align with the baseline level.

In yet another exemplary embodiment, the base plate assembly may further include at least one energy recovery member, e.g., springs, that is configured and disposed to transmit and receive forces imposed on the one or more energy recovery members by the foot plate assembly.

In still a further exemplary embodiment, the base plate assembly may further include an accelerometer operatively connected to the actuator plate. The accelerometer has three degrees of freedom and is in operative communication with controller for detecting movement transmitted by the actuator plate to foot plate assembly of the oscillating vibration device. The accelerometer further detects acceleration of the foot plate assembly and transmits acceleration data to the controller.

In one exemplary embodiment, the base plate assembly further includes controller, wherein the controller determines based on the acceleration data whether to increase, decrease or maintain the electrical signal delivered to the actuator to control the oscillating vibratory force in order to maintain the acceleration of the top plate assembly at a predetermined average acceleration. In one exemplary embodiment, the predetermined average acceleration is 0.3 g peak-to-peak.

In still another exemplary embodiment, the base plate assembly may further include foot plate assembly. The foot plate assembly defines a cavity therein configured and dimensioned to receive the actuator plate such that the actuator plate is in direct contact with the foot plate assembly, the actuator plate transmitting thereby the vibration signal represented by an oscillating vibratory force to the foot plate assembly.

In a still further exemplary embodiment, the base plate assembly may further include an amplifier. The amplifier is in operative communication with the actuator to amplify the vibration signal represented by an oscillating vibratory force to the actuator plate.

The present disclosure relates also to a top plate assembly for oscillating vibration device. The top plate assembly defines cavity therein configured and dimensioned to receive actuator plate such that the actuator plate is in direct contact with the top plate assembly. The actuator plate transmits thereby a vibration signal represented by an oscillating vibratory force to the top plate assembly to operate the oscillating vibration device.

In one exemplary embodiment, the top plate assembly may further include base plate assembly for oscillating vibration device. The top plate assembly is configured and dimensioned to be mounted on the base plate assembly. The base plate assembly includes actuator mounting assembly configured to receive actuator generating a vibration signal represented by an oscillating vibratory force.

The actuator mounting assembly includes an actuator support housing and a mounting cup configured and dimensioned for receiving therein the actuator support housing. The base plate assembly defines a center therein. The actuator mounting assembly is positioned in the base plate assembly at a position offset with respect to the center defined by the base plate assembly. The position of the actuator mounting assembly is generally aligned with the center of pressure of the feet of a user of the oscillating vibration device.

In one exemplary embodiment, the top plate assembly may further include an actuator mounted within the mounting cup and an actuator plate mounted on the actuator support housing. The actuator is configured and dimensioned for transmitting a vibration signal represented by an oscillating vibratory force to the actuator plate. The actuator converts an electrical input signal to the oscillating vibratory force.

In still another exemplary embodiment, the top plate assembly may further include a foot assembly configured for operative communication with a foot plate assembly of the oscillating vibration device. The foot plate assembly defines a baseline level with respect to a surface upon which the top plate assembly is positioned. The foot assembly includes at least one foot assembly actuator in signal communication with a controller such that upon the controller receiving a signal indicating that the foot plate assembly is not aligned with the baseline level, the controller transmits a signal to the at least one foot assembly actuator to adjust the position of the foot plate assembly to align with the baseline level.

In yet another exemplary embodiment, the top plate assembly may further include at least one energy recovery member, e.g., springs, that is configured and disposed to transmit and receive forces imposed on the one or more energy recovery members by the foot plate assembly.

In still a further exemplary embodiment, the top plate assembly may further include an accelerometer operatively connected to the actuator plate. The accelerometer has three degrees of freedom and is in operative communication with controller for detecting movement transmitted by the actuator plate to foot plate assembly of the oscillating vibration device. The accelerometer further detects acceleration of the foot plate assembly and transmits acceleration data to the controller.

In one exemplary embodiment, the top plate assembly further includes the controller wherein the controller determines based on the acceleration data whether to increase, decrease or maintain the electrical signal delivered to the actuator to control the oscillating vibratory force in order to maintain the acceleration of the top plate assembly at a predetermined average acceleration. In one exemplary embodiment, the predetermined average acceleration is 0.3 g peak-to-peak.

In still another exemplary embodiment, the top plate assembly may further include foot plate assembly. The foot plate assembly defines a cavity therein configured and dimensioned to receive the actuator plate such that the actuator plate is in direct contact with the foot plate assembly, the actuator plate transmitting thereby the vibration signal represented by an oscillating vibratory force to the foot plate assembly.

In a still further exemplary embodiment, the top plate assembly may further include an amplifier. The amplifier is in operative communication with the actuator to amplify the vibration signal represented by an oscillating vibratory force to the actuator plate.

The present disclosure relates also to a vibration device that includes top plate assembly defining cavity therein that is configured and dimensioned to receive actuator plate such that the actuator plate is in direct contact with the top plate assembly. The actuator plate transmits thereby a vibration signal represented by an oscillating vibratory force to the top plate assembly to operate the oscillating vibration device.

In one embodiment, the vibration device further includes base plate assembly for the vibration device. The top plate assembly is configured and dimensioned to be mounted on the base plate assembly. The base plate assembly includes actuator mounting assembly that is configured to receive actuator generating a vibration signal represented by an oscillating vibratory force.

The actuator mounting assembly includes an actuator support housing and a mounting cup configured and dimensioned for receiving therein the actuator support housing. The base plate assembly defines a center therein. The actuator mounting assembly is positioned in the base plate assembly at a position offset with respect to the center defined by the base plate assembly. The position of the actuator mounting assembly is generally aligned with the center of pressure of the feet of a user of the oscillating vibration device.

In one exemplary embodiment, the oscillating vibration device may further include an actuator mounted within the mounting cup and an actuator plate mounted on the actuator support housing. The actuator is configured and dimensioned for transmitting a vibration signal represented by an oscillating vibratory force to the actuator plate. The actuator converts an electrical input signal to the oscillating vibratory force.

In still another exemplary embodiment, the oscillating vibration device may further include a foot assembly configured for operative communication with a foot plate assembly of the oscillating vibration device. The foot plate assembly defines a baseline level with respect to a surface upon which the oscillating vibration device is positioned. The foot assembly includes at least one foot assembly actuator in signal communication with a controller such that upon the controller receiving a signal indicating that the foot plate assembly is not aligned with the baseline level, the controller transmits a signal to the at least one foot assembly actuator to adjust the position of the foot plate assembly to align with the baseline level.

In yet another exemplary embodiment, the oscillating vibration device may further include at least one energy recovery member, e.g., springs, that is configured and disposed to transmit and receive forces imposed on the one or more energy recovery members by the foot plate assembly.

In still a further exemplary embodiment, the oscillating vibration device may further include an accelerometer operatively connected to the actuator plate. The accelerometer has three degrees of freedom and is in operative communication with controller for detecting movement transmitted by the actuator plate to foot plate assembly of the oscillating vibration device. The accelerometer further detects acceleration of the foot plate assembly and transmits acceleration data to the controller.

In one exemplary embodiment, the oscillating vibration device further includes controller, wherein the controller determines based on the acceleration data whether to increase, decrease or maintain the electrical signal delivered to the actuator to control the oscillating vibratory force in order to maintain the acceleration of the oscillating vibration device at a predetermined average acceleration. In one exemplary embodiment, the predetermined average acceleration is 0.3 g peak-to-peak.

In still another exemplary embodiment, the oscillating vibration device may further include foot plate assembly. The foot plate assembly defines a cavity therein configured and dimensioned to receive the actuator plate such that the actuator plate is in direct contact with the foot plate assembly, the actuator plate transmitting thereby the vibration signal represented by an oscillating vibratory force to the foot plate assembly.

In a still further exemplary embodiment, the oscillating vibration device 10 may further include an amplifier. The amplifier is in operative communication with the actuator to amplify the vibration signal represented by an oscillating vibratory force to the actuator plate.

Still further, the present disclosure relates to a method of operating oscillating vibration device that includes transmitting a vibration signal represented by an oscillating vibratory force to foot plate assembly of the oscillating vibration device, measuring via accelerometer having three degrees of freedom acceleration of the foot plate assembly and transmitting acceleration data to controller, determining via the controller based on the acceleration data whether to increase, decrease or maintain the electrical signal delivered to the actuator in order to maintain the acceleration of the top plate assembly at a predetermined average acceleration.

In one exemplary embodiment, maintaining the acceleration of the top plate assembly at a predetermined average acceleration may include maintaining the acceleration of the top plate assembly at a predetermined average acceleration of 0.3 g peak-to-peak.

The method may further include, wherein the foot plate assembly defines a baseline level with respect to a surface upon which the oscillating vibration device is positioned, upon the controller receiving a signal indicating that the foot plate assembly is not aligned with the baseline level, the controller transmitting a signal to at least one foot assembly actuator to adjust the position of the foot plate assembly to align with the baseline level.

Thus, the potential to improve bone and muscle quality and quantity using specific components of the complex mechanical environment as a 'surrogate' for exercise and key physical signals lost with aging provides the basis of the Vibration Device's position as a drug-free intervention against the decline of the musculoskeletal system, including other connective tissues (e.g., cartilage, ligament, tendon). Indeed, a mechanical strategy has unique advantages over pharmaceutical therapy, as mechanical signals are self-targeted (maximum strain will occur in the weakest loci on bone matrix) and self-regulatory (increased bone formation in the weak loci will reduce strain, and thus inherently reduce the signal).

BRIEF DESCRIPTION OF THE DRAWINGS

These and other advantages will become more apparent from the following detailed description of the various embodiments of the present disclosure with reference to the drawings wherein.

DETAILED DESCRIPTION

Figure 1:
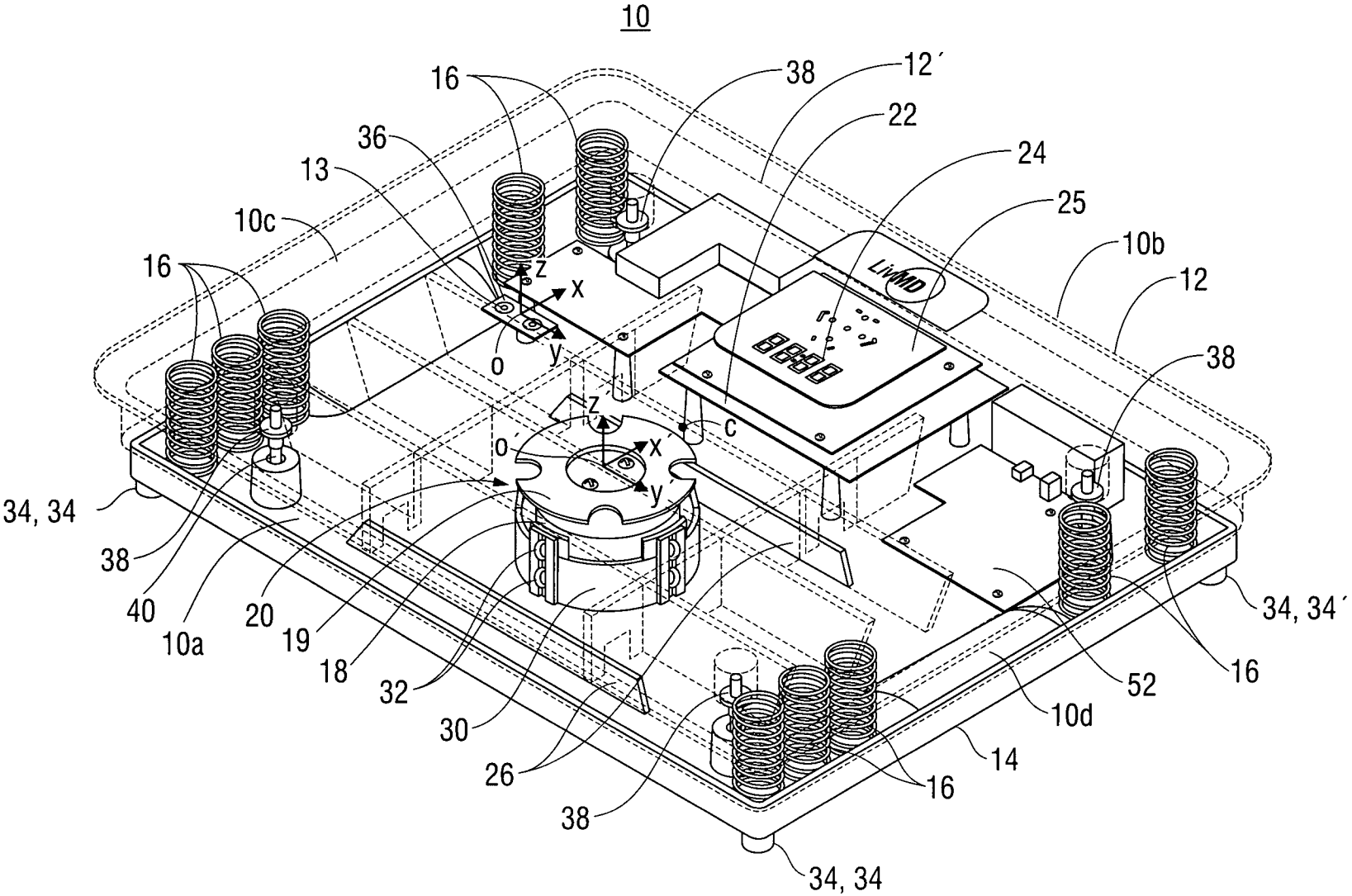
FIG. 1 is a top, perspective phantom view of an oscillating vibration device with a foot plate assembly according to one embodiment of the present disclosure.

The vibration device of the present disclosure delivers low magnitude vibration signals at a frequency of 30-90 cycles per second (Hz) to provide enhanced physical stimulation of cell growth. Other frequency ranges are also contemplated such as 1-100 HZ and other sub-ranges therein, such as, e.g., 25-35 Hz, including specific frequencies therein, such as, e.g., 10 Hz. The low intensity vibrations are also characterized by their intensity. The intensity can range from 0.01 g to 10 g (where 1.0 g=earth's gravitational field=9.8 m/s/s), and other sub-ranges therein, such as, e.g., 0.01 g to 4.0 g, and specific magnitudes therein, such as, e.g., 0.3 g.

To visualize the low magnitude mechanical signal, consider that to maintain postural stability, the synergistic and anagonistic musculature of the legs, arm and trunk are all working together towards stable balance. Muscles are essentially inefficient motors that during contraction elicit small mechanical oscillations, or vibrations, between 10-60 Hz. These extremely small contractions of the muscle, the contractability spectra, generate correspondingly small accelerations on the tissues, including bone, fat, cartilage, tendon, ligament and marrow, as well as the resident cell population, including bone cells (osteoblasts and osteocytes), fat cells (adipocytes), cartilage cells (chondrocytes), and the stem cells residing in the marrow and other organ systems (e.g., mesenchymal stem cells, or MSC, and hematopoietic stem cells, or HSC).

The Vibration Device of the present disclosure is designed and optimized to mimic the contractile spectrum of healthy muscle, and in case of injury, age, infirmity or disease, serve as a surrogate to deliver a biologically relevant regulatory signal to the cells in the body that can sense and respond to the mechanical stimulus. These signals, while small, have been shown to be anabolic to bone and muscle, accelerate wound healing and bone repair, suppress adipogenesis, and markedly bias the fate selection of MSC and HSC.

The Vibration Device according to the present disclosure can be programmed to deliver highly controlled, low intensity vibrations at a particular intensity and frequency, such as, e.g., a 30 Hz sinusoidal waveform delivered at 0.3 g peak-to-peak, by utilizing a closed-loop feedback system, using acceleration feedback as the error signal, as described below. As such, the Vibration Device can be described as a low intensity vibration (LIV) device.

The LIV Device's development is based on leveraging the strong sensitivity of cells to mechanical stimuli. While 0.3 g acceleration does not feel like much to an individual, it is a strong physical signal to an individual cell, and plays an important part in its viability and its fate selection.

While this work was originally focused on musculoskeletal applications because bone and muscle tissue are readily recognized for their strong sensitivity to mechanical signals, research studies have indicated that other cells aside from those that formed bone and muscle could also respond to mechanical stimuli.

In particular, the research on bone tissue and how the mechanical forces were being sensed in bone led to studies on the bone-marrow-derived stem-cell population, and in particular, mesenchymal stem cells (MSCs). Patent applications directed to this research and other research by the named inventor of the present disclosure are pending, including, for example, (1) U.S. patent application Ser. No. 12/300,958 filed on Nov. 14, 2008, published as US Patent Application Publication US 2010/0028968 A1 "BIOMECHANICAL TREATMENT FOR OBESITY AND DIABETES" on Feb. 4, 2010, which is a National Stage application under 35 USC Section 371 and claims the benefit under 35 USC Section 119(a) of International Application No. PCT/US07/69154 filed on May 17, 2007, published as WO 2007/137123 A2 on Nov. 29, 2007, which claims the benefit of priority under 35 USC Section 119(e) to U.S. Patent Application Ser. No. 60/801,325 filed on May 17, 2006, and (2) U.S. patent application Ser. No. 12/919,533 filed on Aug. 26, 2010, published as US Patent Application Publication US 2011/0070206 A1 "METHODS OF APPLYING PHYSICAL STIMULI TO CELLS", on Mar. 24, 2011, which is a National Stage application under 35 USC Section 371 and claims the benefit under 35 USC Section 119(a) of International Application No. PCT/US09/35777 filed on Mar. 2, 2009, published as WO 2009/108953 A1 on Sep. 3, 2009, which claims the benefit of priority under 35 USC Section 119(e) to U.S. Patent Application Ser. No. 61/032,942 filed on Feb. 29, 2008, all of which are incorporated herein by reference in their entirety.

MSCs are an adult stem cell population primarily found in the bone marrow, and are able to differentiate into various cell types including bone cells (osteoblasts), fat cells (adipocytes), fibroblasts, cartilage cells (chondrocytes), and muscle cells (myocytes). Studies examining the therapeutic potential of mesenchymal stem cells have greatly increased in recent years, and the mechanical control of stem cell proliferation and differentiation is what makes the LIV Device of the present disclosure applicable to so many different diseases. Importantly, the mechanical influence on stem-cell activity is critical not only to tissue health, but to the regenerative capacity of organ systems.

Recent work in animals has indicated that low intensity vibration (LIV) can suppress the formation of fat (adipogenesis) and that the reduced fat mass in essence can protect against diseases typically associated with obesity. For instance, the development of non-alcoholic fatty liver disease (NAFLD) has been shown to be attenuated by long term application of LIV signals, and that the hepatocytes themselves are sensitive to the LIV signals. The LIV technology has been shown in four completed human clinical trials (each published in the peer-reviewed literature) to provide a unique, safe and effective enhancement of bone mineral density, a key step in the prevention of bone loss, and protection of postural stability (through the stimulation of muscle), a key step in reduction of falls.

As described in detail in the Scientific Review of Marodyne Medical, based in Lakeland, Fla., results from animal and clinical studies indicate that replacing the regulatory mechanical signals that decay with aging, injury, infirmity or disuse with exogenously-delivered mechanical stimulation can help protect bone and muscle, preserve postural stability, as well as the regenerative capacity of the stem cell pool.

The embodiments of the present disclosure implement the results of several decades of searching for the mechanical signal to which bone and muscle are responsive. The understanding established herein based on this long history of research is that the biological system is extremely complex, and that there is a small therapeutic window where biophysical stimuli are effective. Importantly, these data emphasize that the mechanical signals need not be large to be effective, and that low magnitude or low intensity mechanical signals, induced in the higher frequency range described here (10-100 Hz) can readily affect the musculoskeletal phenotype and influence the activity of the resident cell population and stem cell progenitors. This is achieved without putting the cell, tissue, organ or organism at risk, which is an inescapable outcome when a cell, animal or human is subject to high magnitude vibrations, as outlined in ISO-2631 [(International Standards Organization) "Mechanical vibration and shock—Evaluation of human exposure to whole-body vibration" which specifies thresholds for human exposure to vibration)]. The Vibration Device provides a unique means of introducing these key regulatory, low intensity signals into the standing human, tissue system, or cell system, in a controlled fashion.

The Vibration Device

Structure of the Vibration Device

Turning now to embodiments of the details of the oscillating vibration device according to the present disclosure, various phantom and sectional views of the Vibration Device of the present disclosure are shown by FIGS. 1-7. Several of the various key components of the Vibration Device (herein after "Device") of the present disclosure are shown by FIGS. 8-15. A control and power distribution schematic for the oscillating vibration device is illustrated in FIG. 16.

With reference to FIG. 1, there is shown a top, perspective phantom view of the oscillating vibration device, hereinafter referred to as the Device which is designated by reference numeral 10.

Figure 2:
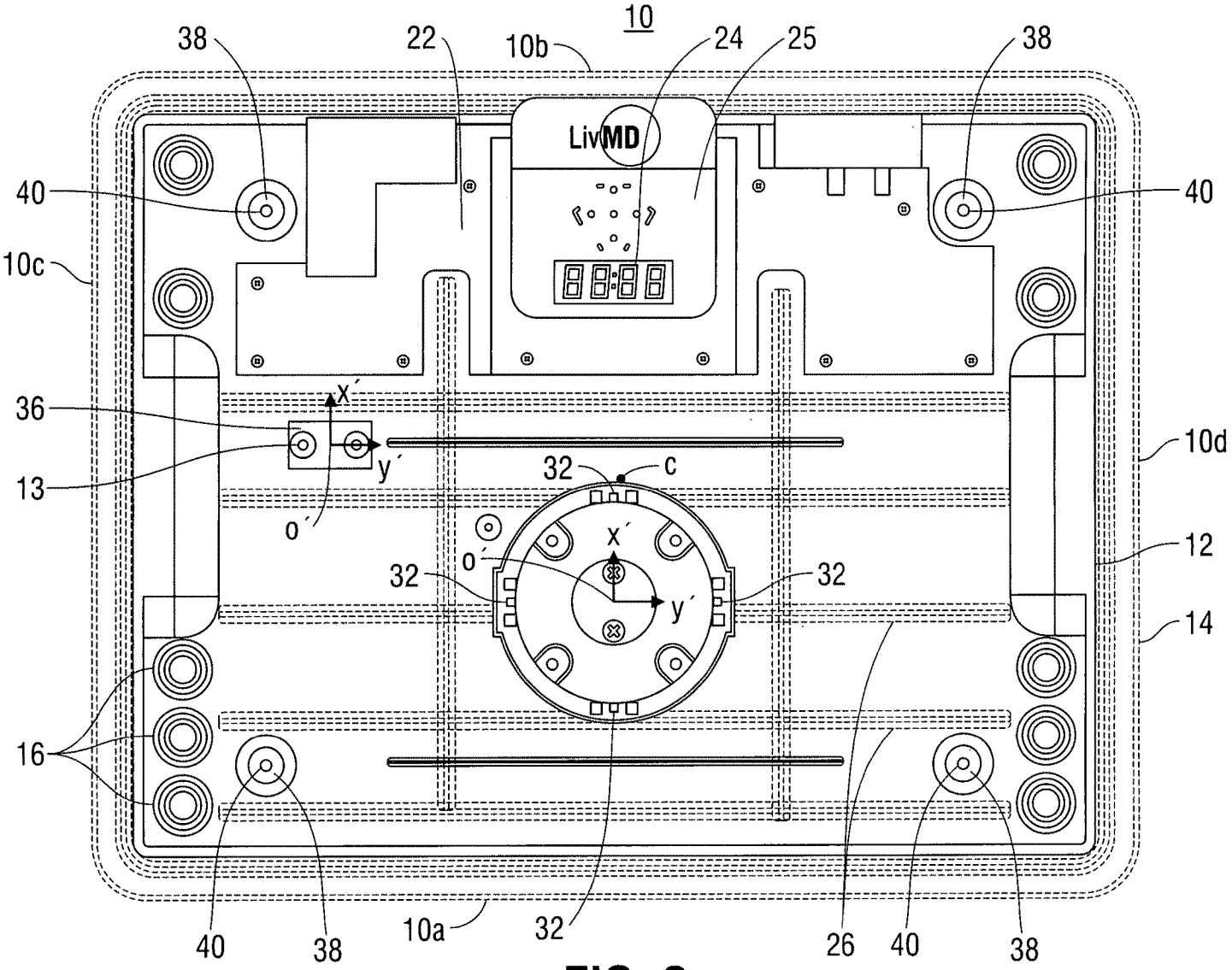
FIG. 2 is a phantom plan view of the oscillating vibration device of FIG. 1.

FIG. 2 is a phantom plan view of the Device 10 of FIG. 1 directly facing a foot or top plate assembly 12.

Figure 3:
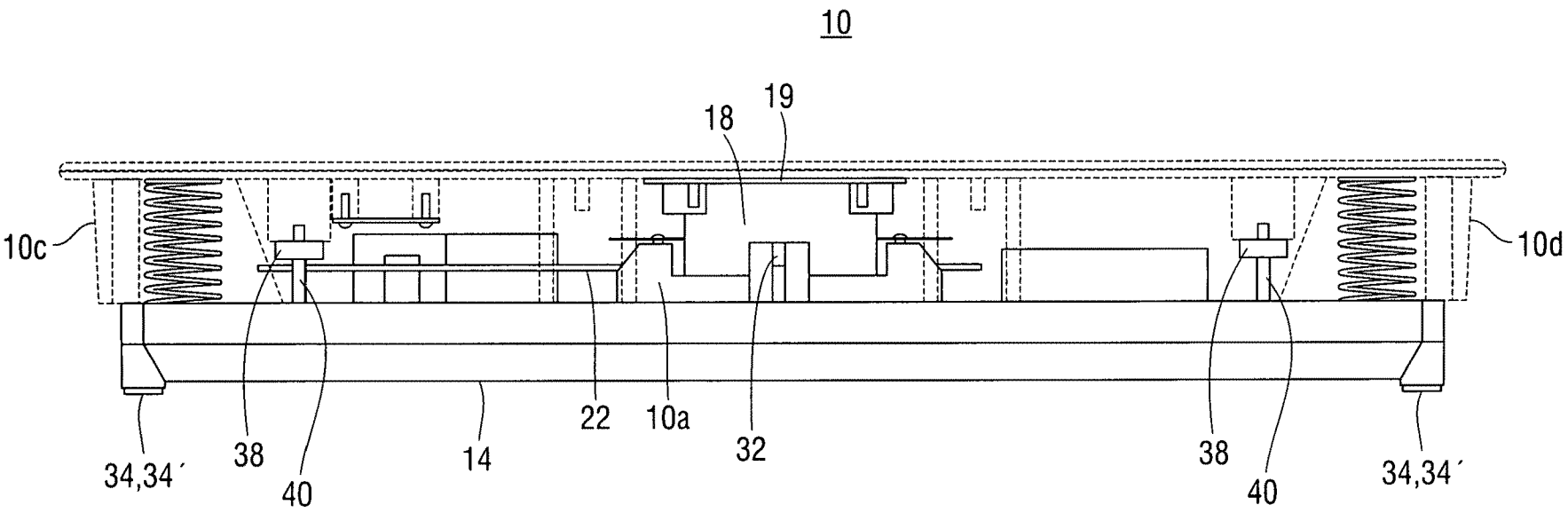
FIG. 3 is a phantom elevation view of one side of the oscillating vibration device of FIG. 1 that is positioned generally behind the user of the device during operation of the oscillating vibration device.

FIG. 3 is a phantom elevation view of one side 10*a* of the Device 10 of FIG. 1 that is positioned generally behind the user of the Device 10 during operation of the Device 10.

Figure 4:
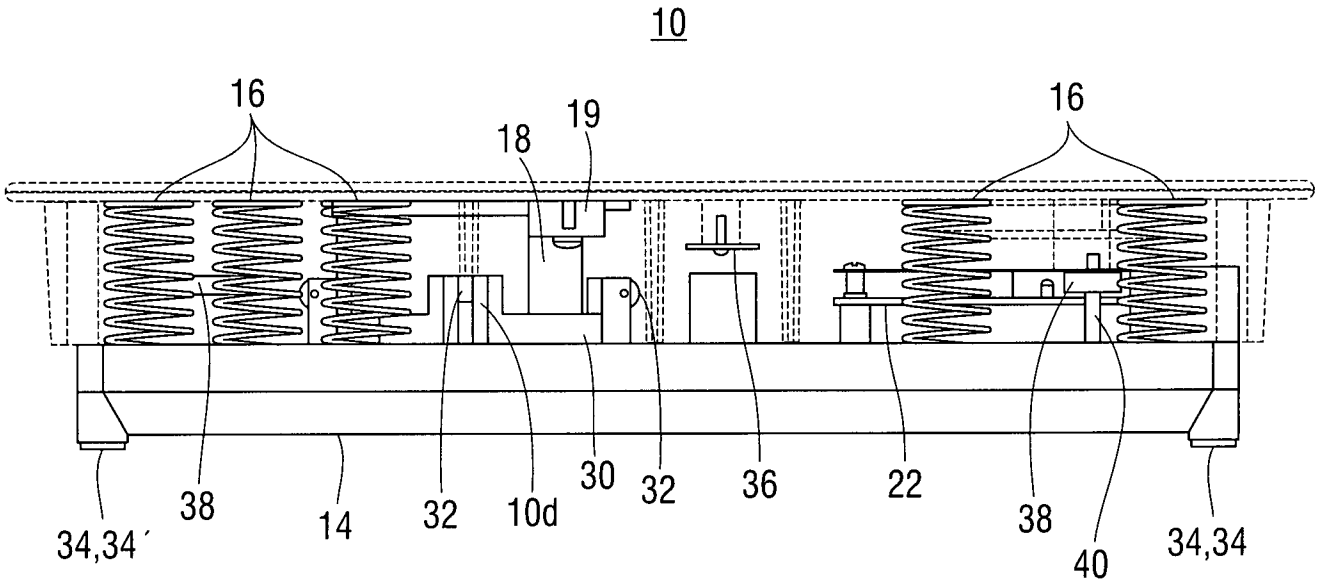
FIG. 4 is a phantom elevation view of another side of the oscillating vibration device of FIG. 1 that is positioned generally to the right of the user of the device during operation of the oscillating vibration device.

FIG. 4 is a phantom elevation view of another side 10*d* of the Device 10 of FIG. 1 that is positioned generally to the right of the user of the Device 10 during operation of the Device.

Figure 5:
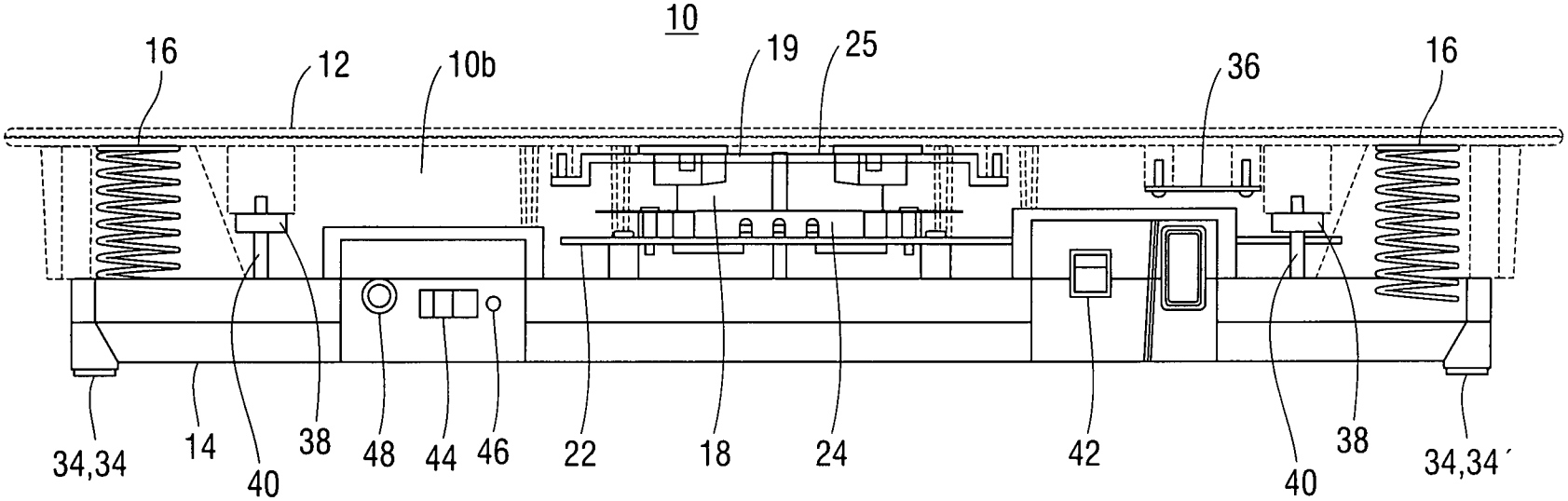
FIG. 5 is a phantom elevation view of one side of the oscillating vibration device of FIG. 1 that is positioned generally in front of the user of the device during operation of the oscillating vibration device.

FIG. 5 is a phantom elevation view of one side 10*b* of the Device 10 of FIG. 1 that is positioned generally in front of the user of the Device 10 during operation of the oscillating vibration device.

Figure 6:
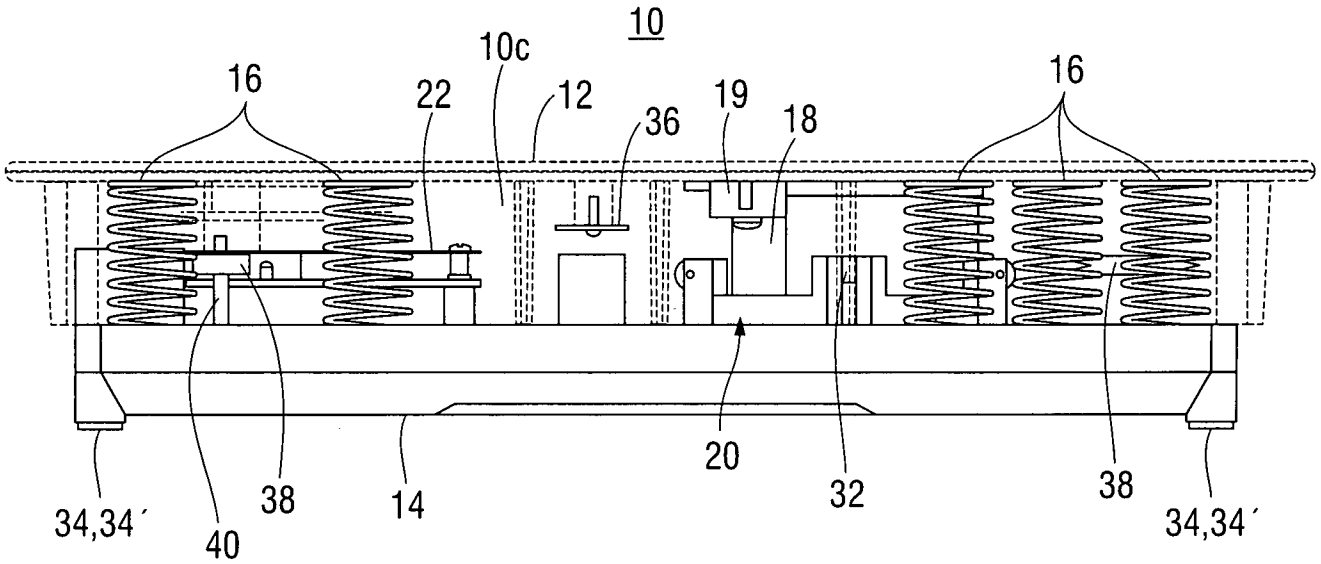
FIG. 6 is a phantom elevation view of another side of the oscillating vibration device of FIG. 1 that is positioned generally to the left of the user of the device during operation of the oscillating vibration device.

FIG. 6 is a phantom elevation view of another side 10*c* of the Device of FIG. 1 that is positioned generally to the left of the user of the Device 10 during operation of the Device 10.

Figure 7:
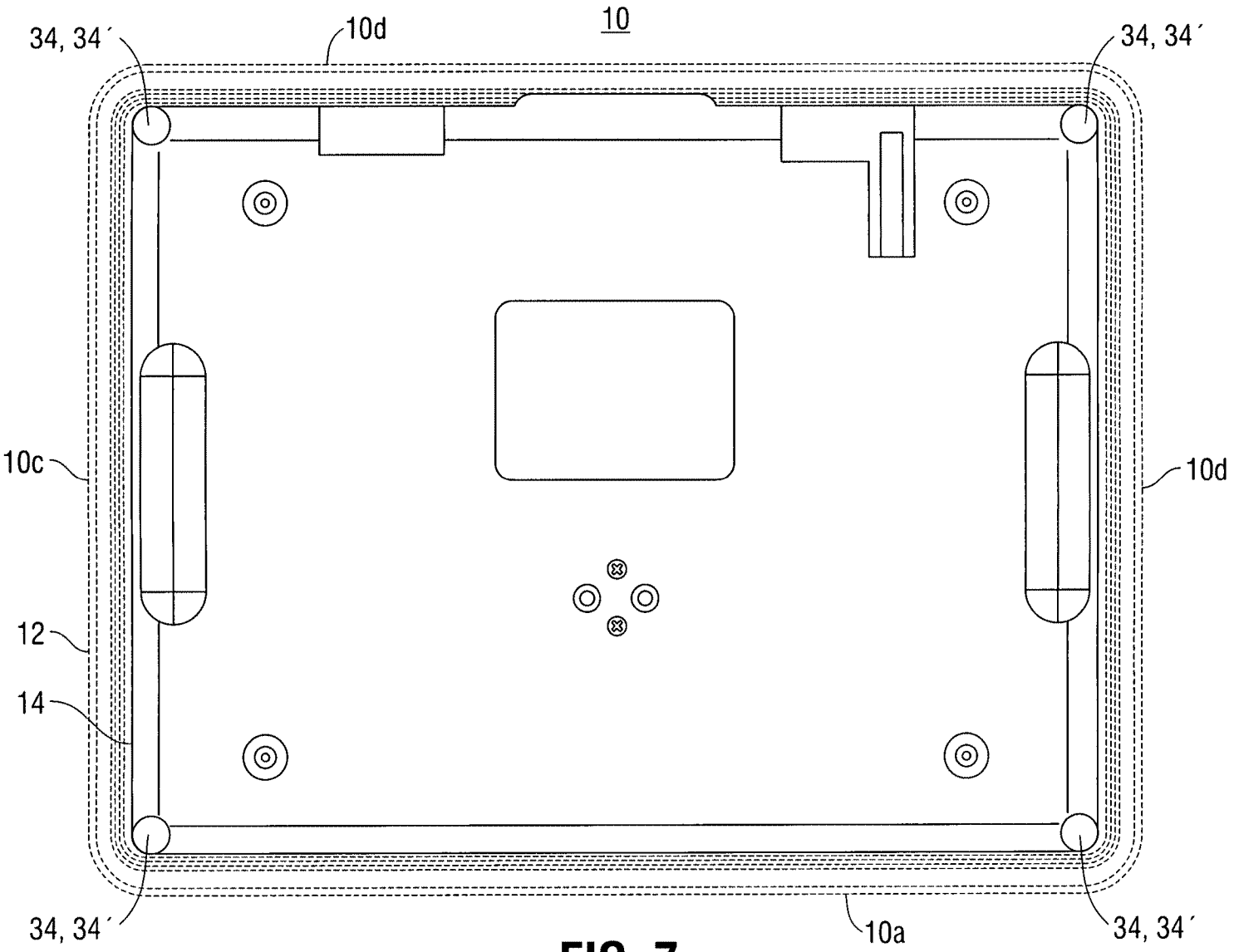
FIG. 7 is a bottom plan view of the oscillating vibration device of FIG. 1 with a base plate assembly installed on the bottom of the oscillating vibration device.

FIG. 7 is a bottom plan view of Device 10 of FIG. 1 with a base plate assembly 14 installed on the bottom of the Device 10.

Figure 8A:
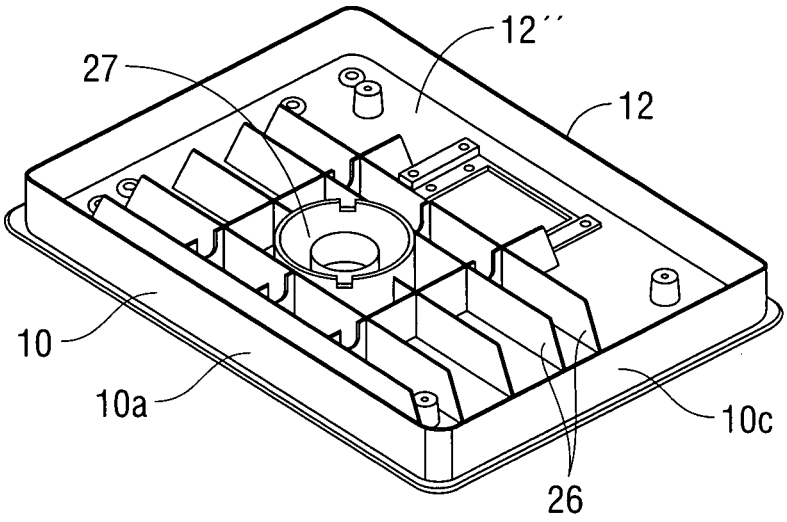
FIG. 8A is a perspective underneath assembled view of the foot plate assembly of the oscillating vibration device of FIGS. 1-7.

FIG. 8A is a perspective underneath assembled view of the foot plate assembly 12 of the Device 10 of FIGS. 1-7 showing a cavity 27 in the foot plate assembly 12 to receive and interface with the actuator plate 19.

Figure 8B:
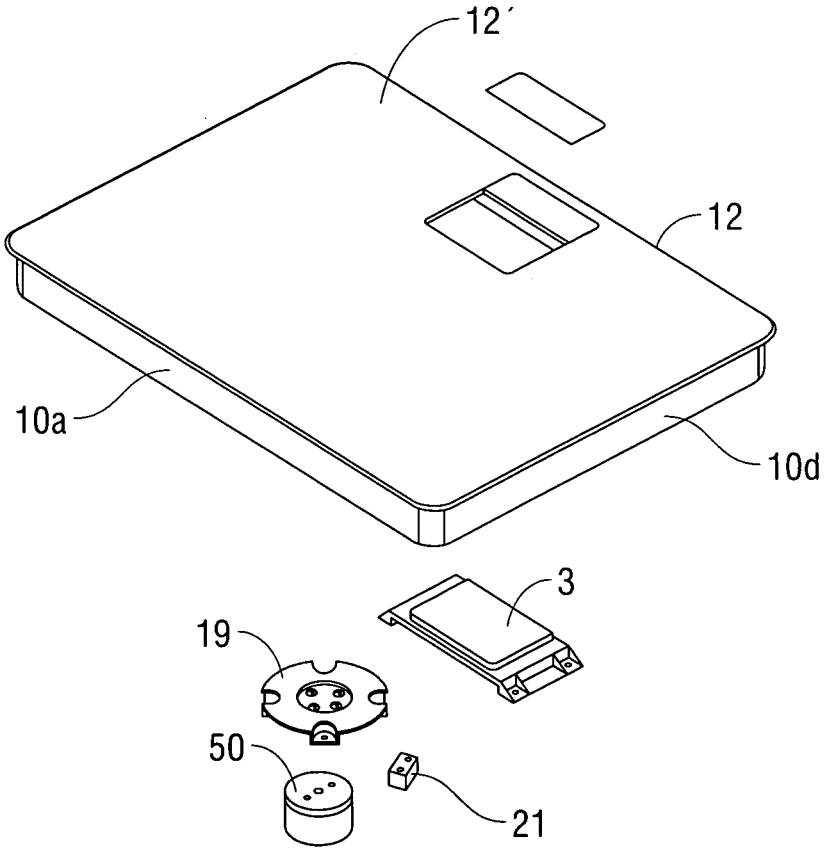
FIG. 8B is a perspective top exploded view of the foot plate assembly and other components of the oscillating vibration device of FIG. 8A.

FIG. 8B is a perspective top exploded view of the foot plate assembly 12 and other components of the Device 10 of FIG. 8A.

Figure 9A:
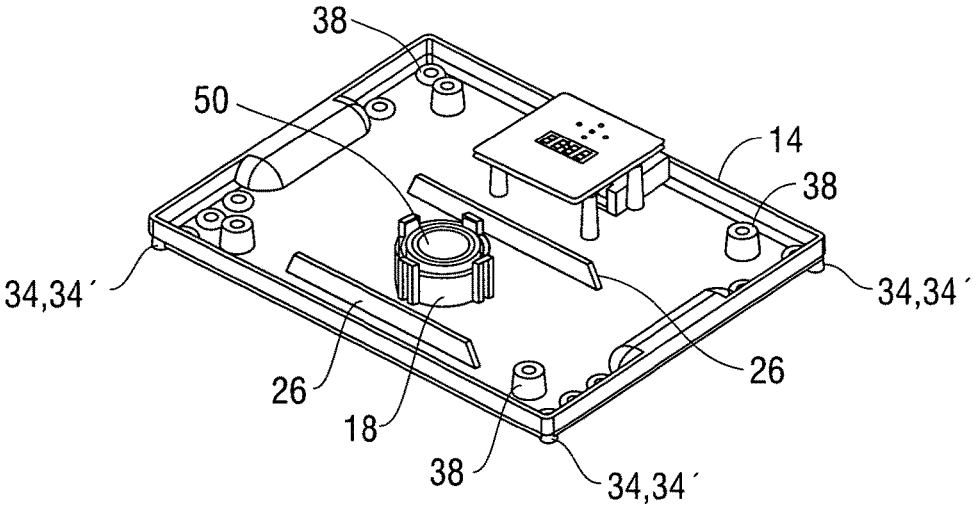
FIG. 9A is a top perspective view of a base plate assembly and other components of the oscillating vibration device of FIGS. 1-7.

FIG. 9A is a top perspective view of a base plate assembly 14 and other components of the oscillating vibration device of FIGS. 1-7.

Figure 9B:
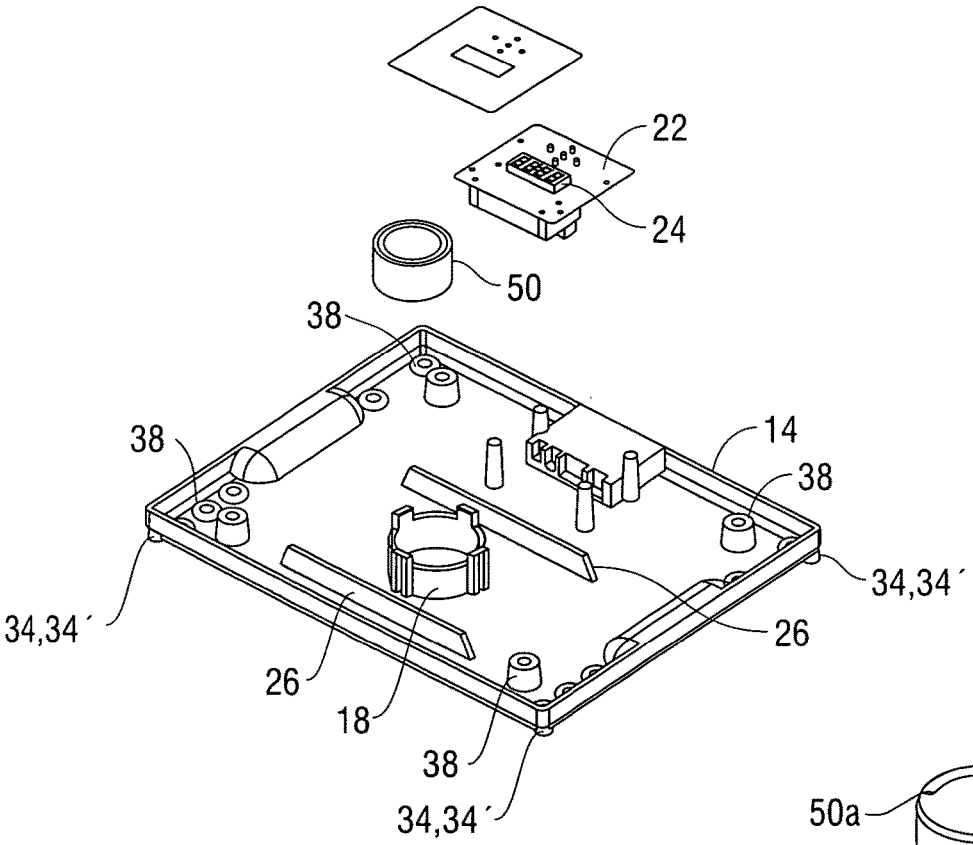
FIG. 9B is a top perspective exploded view of the base plate assembly and other components of the oscillating vibration device of FIG. 9A.

FIG. 9B is a top perspective exploded view of the base plate assembly 14 and other components of the oscillating vibration device of FIG. 9A.

Figure 9C:
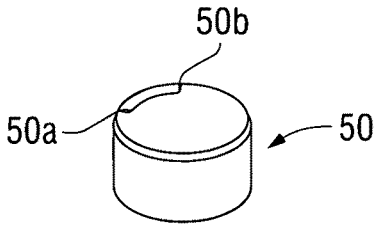
FIG. 9C is a top perspective view of an actuator that provides a low intensity vibration signal for the oscillating vibration device of FIGS. 1-7.

FIG. 9C is a top perspective view of an actuator 50 having leads 50*a* and 50*b* of a solenoid coil (not shown) that provides a low intensity vibration signal for the Device 10 of FIGS. 1-7.

Figure 10A:
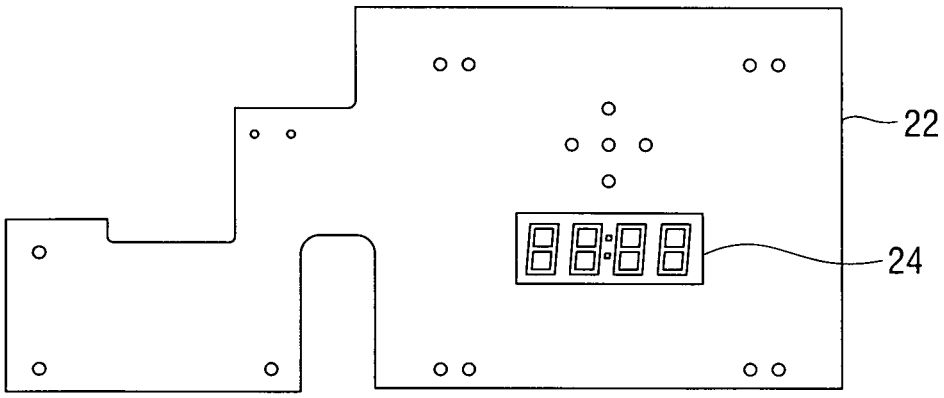
FIG. 10A is a plan view of the controller logic printed circuit board assembly and display for the oscillating vibration device of FIGS. 1-7.

FIG. 10A is a plan view of the controller logic printed circuit board assembly 22 and display 24 for the oscillating vibration device of FIGS. 1-7.

Figure 10B:
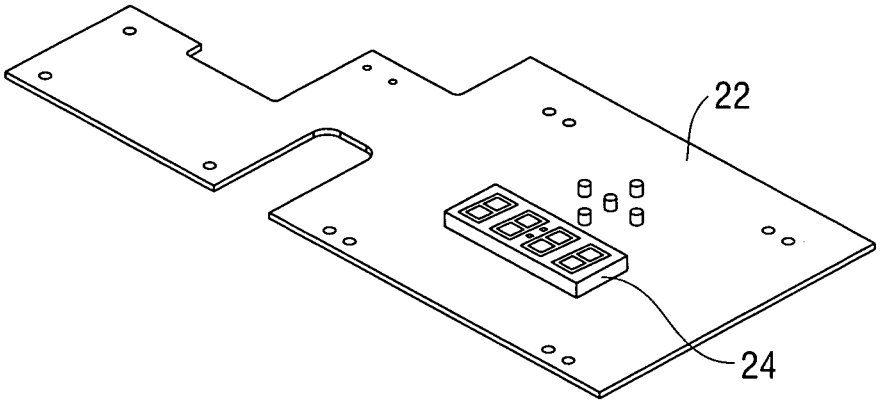
FIG. 10B is a perspective top view of the controller logic printed circuit board assembly and display of FIG. 10A.

FIG. 10B is a perspective top view of the controller logic printed circuit board assembly 22 and display 24 of FIG. 10A.

Figure 11A:
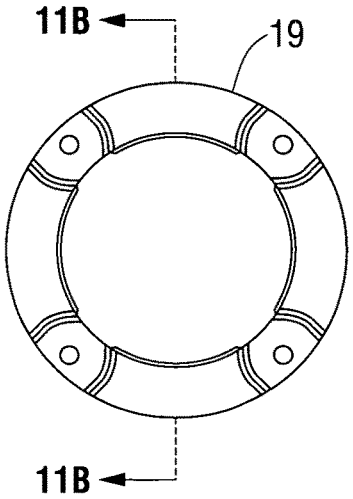
FIG. 11A is a top plan view of the actuator plate for the oscillating vibration device of FIGS. 1-7.

FIG. 11A is a top plan view of an actuator plate 19 for the Device 10 of FIGS. 1-7.

Figure 11B:
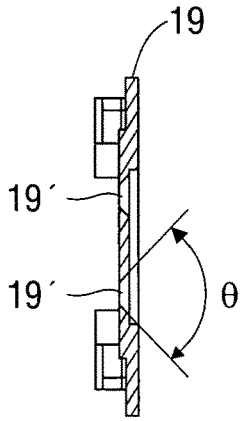
FIG. 11B is a section view of the actuator plate taken along section line 11B-11B of FIG. 11A.

FIG. 11B is a section view of the actuator plate 19 taken along section line 11B-11B of FIG. 11A showing apertures 19' that are chamfered at an angle Θ to enable mounting of the actuator plate 19 via screws.

Figure 11C:
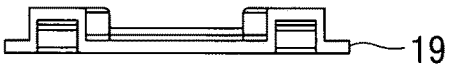
FIG. 11C is an elevation view of the actuator plate of FIGS. 11A and 11B.

FIG. 11C is an elevation view of the actuator plate 19 of FIGS. 11A and 11B.

Figure 11D:
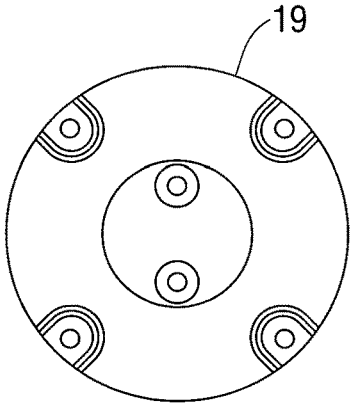
FIG. 11D is a bottom plan view of the actuator plate of FIGS. 11A, 11B and 11C.

FIG. 11D is a bottom plan view of the actuator plate 19 of FIGS. 11A, 11B and 11C.

Figure 11E:
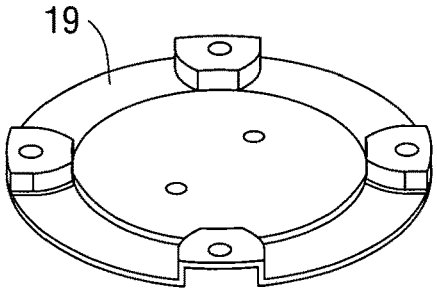
FIG. 11E is a top perspective view of the actuator plate of FIGS. 11A-11D.

FIG. 11E is a top perspective view of the actuator plate 19 of FIGS. 11A-11D.

Figure 12:
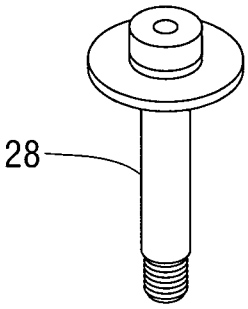
FIG. 12 is a top perspective view of a guide screw for the oscillating vibration device of FIGS. 1-7.

FIG. 12 is a top perspective view of a guide screw 28 for the Device 10 of FIGS. 1-7.

Figure 13:
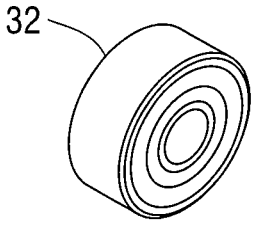
FIG. 13 is a top perspective view of a roller bearing for the oscillating vibration device of FIGS. 1-7.

FIG. 13 is a top perspective view of a roller bearing 32 for the Device 10 of FIGS. 1-7.

Figure 14:
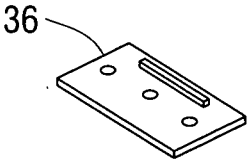
FIG. 14 is a top perspective view of the accelerometer printed circuit board assembly for the oscillating vibration device of FIGS. 1-7.

FIG. 14 is a top perspective view of an accelerometer printed circuit board assembly 36 for the Device 10 of FIGS. 1-7.

Figure 15:
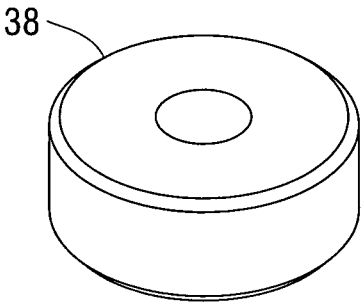
FIG. 15 is a top perspective view of a limit bumper for the oscillating vibration device of FIGS. 1-7.
Figure 16:
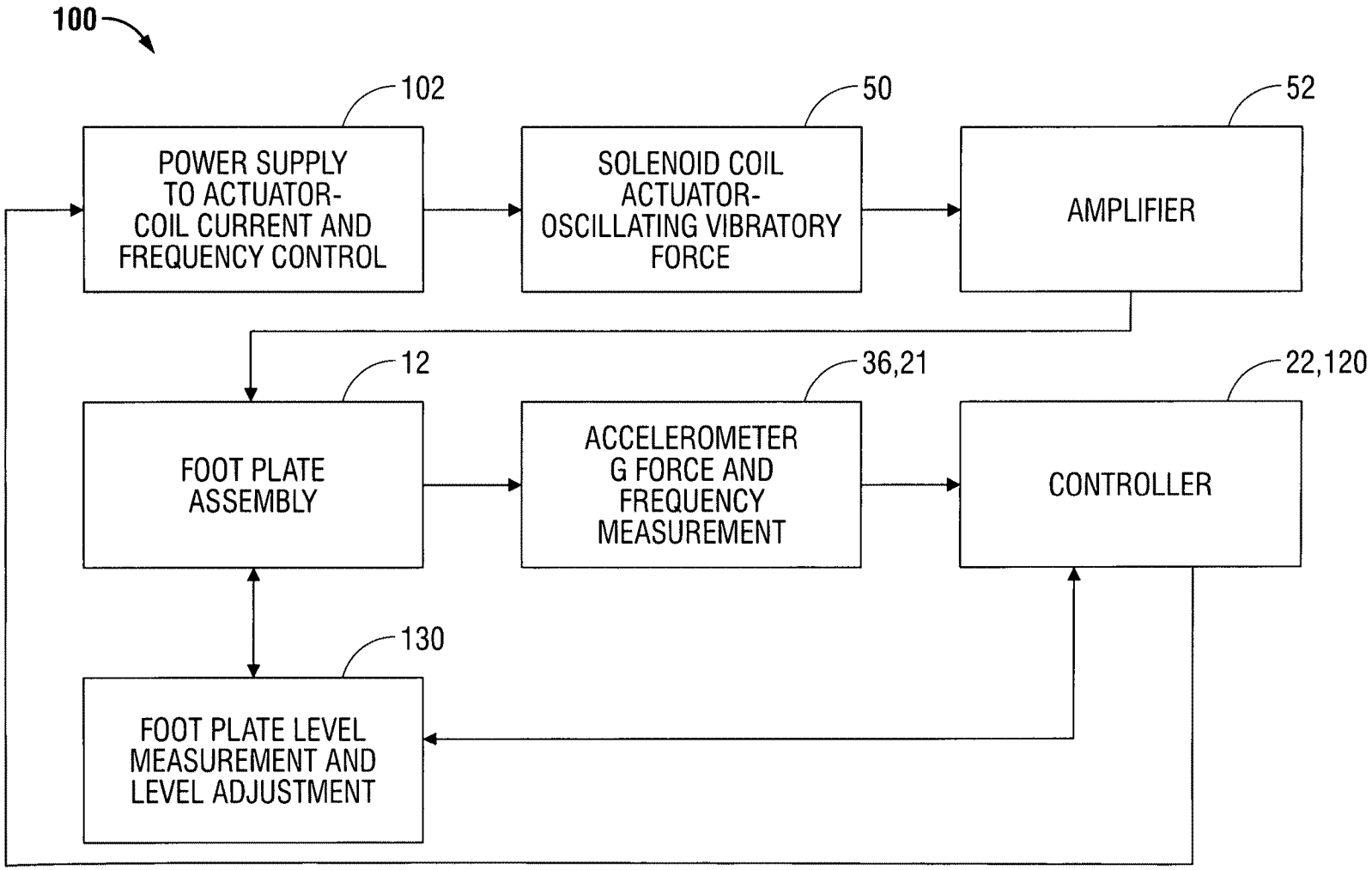
FIG. 16 is a schematic diagram for the control and power distribution for the oscillating vibration device of FIGS. 1-15.

FIG. 15 is a top perspective view of a limit bumper 38 for the Device 10 of FIGS. 1-7.

Several of the components visible in FIG. 1 include top or foot plate assembly 12 (see also FIGS. 8A and 8B), base plate assembly 14 (see also FIGS. 9A and 9B), a plurality of springs 16 mounted on the base plate assembly 14 to support the top plate assembly 12, an actuator support housing 18 (see also FIGS. 9A and 9B) having an actuator plate 19 mounted thereto (see also FIGS. 11A-11E) for housing therein an actuator 50 (e.g., a voice coil actuator or solenoid coil available from Kunshan Tongmao Electronics, Co., Ltd.—see FIGS. 9A and 9C) for generating the desired low intensity vibrations via an oscillating vibratory force, an actuator accelerometer 21 mounted between the actuator 50 and the actuator plate 19, an actuator mounting assembly 20, a controller logic printed circuit board assembly 22 (see also FIGS. 10A and 10B) and associated electronics and circuitry, including a display 24 having a lens covering 25 (see also FIGS. 10A and 10B), an amplifier 52 (see FIG. 1) for amplifying the low magnitude LIV mechanical signal described herein above that is generated by the actuator 50, and at least one controller 22, processor or microprocessor (collectively referred to herein as a "controller") capable of executing a set of programmable instructions for operating the Device 10, in terms of frequency, intensity, duration and waveform.

The set of programmable instructions, or a sub-set thereof, can be pre-loaded to a memory of the controller at the time of manufacturing the Device 10, downloaded to the Device 10 by an end user by one of several methods, such as, by a wireless connection to a remote server storing the programmable instructions, via a hard-wired connection to the remote server via the Internet (e.g., via an Ethernet connection via an Ethernet port 42 (see FIG. 5)), via a bluetooth connection to a local computing device, such as, for example, a smartphone, in operative communication with the remote server, by the use of a memory stick, such as a flash memory drive, by scanning a two- or three-dimensional code (e.g., Quick Response Code (QRC), a two-dimensional matrix code) using a smartphone in operative communication with the Device 10 (for example, calling a phone number using the smartphone to initiate transmission of programmable instructions to the Device 10), etc.

The Device 10 includes an onboard memory module for storing a default mode and other information, such as, information preloaded by the manufacturer, or information specified by a user, surgeon, therapist, physician, or other health care professional. The memory can also be preloaded with a treatment regimen, such as, for example, 30 Hz, 0.3 g, for 10 minutes per day. The Device 10 can also include a USB port or other port for downloading information to the onboard memory module. A computing device can also be connected via a port to the Device 10 for controlling the signal to the actuator 50, via computer programs, such as, e.g., MathLab or LabView.

In embodiments, Device 10 is self-calibrating with a series of error visible/audible signals if the frequency, intensity, duration or other operating parameter is not within a specific range of error, allowing users to trouble shoot issues with the Device 10.

All of these and other programming methods can be used to reprogram the Device 10 with operator-defined treatment regimens, such as, for example, a health care practitioner can download treatment regimens for a particular subject on a memory stick and provide it to the subject (e.g., week one, 0.1 g for five minutes per day at 25 Hz; week two, 0.2 g for eight minutes per day at 35 Hz; and weeks three to eight, 0.3 g at 30 Hz for ten minutes per day). The subject can then insert the memory stick into the Device 10 and the Device 10 is reprogrammed with at least one treatment regimen. Compliance measures can be recorded or stored in the onboard memory module, indicating date, time and duration of use for evaluation at a future time.

In embodiments, the Device 10 can be used to monitor whether the subject is following the programmed compliance metric or treatment regimen, regardless of whether the compliance metric or treatment regimen was programmed by the subject or by the manufacturer of the Device 10. The Device 10 can regularly or irregularly transmit data to a remote server or computing device, where the data includes whether the subject following a particular compliance metric or treatment regimen. Messages can then be transmitted to the Device 10, and/or a computing device associated with the user, such as, for example, the user's smartphone, informing the user whether he or she has or has not followed the particular compliance metric or treatment regimen. Instead of or in addition to messages being transmitted to the Device 10, a voice communication can be placed to the Device 10 or computing device associated with the user by a health care practitioner or other person informing the user of his or her compliance or non-compliance to the compliance metric or treatment regimen. Other messages can also be transmitted to the user, such as messages of congratulations for reaching a milestone or completing a treatment regimen, and messages of encouragement.

In embodiments of the Device 10, the Device 10 is equipped with a transceiver for communicating with a remote server or other computing device for receiving communications data from the remote server or other computing device, including programmable instructions. For example, the programmable instructions can reprogram the Device 10 such that the Device 10 operates in accordance with a predefined regimen, such as, for example, operate the Device 10 with a signal having a magnitude of 0.1 g for 15 minutes a day for one week, then operate the Device 10 with a signal having a magnitude of 0.3 g for 10 minutes a day for five weeks, and then operate the Device 10 with a signal having a magnitude of 0.7 g for 5 minutes a day for ten weeks.

The Device 10 can be programmed, via one or more of the programming methods described herein and other contemplated methods, according to duration of use, amplitude or magnitude of signal, and/or frequency (e.g., principal and harmonics). In embodiments, the Device 10 can be programmed such that the low magnitude signal can have any type of signal, such as a sinusoidal signal, sawtooth signal, step signal, triangular signal, square signal, pulses, compound signal, etc. A compound signal includes two or more signals, such as, for example, one could program the Device 10 to produce a compound signal having a 30 Hz 0.3 g sine wave as the principal signal, combined with a 90 Hz 0.2 g sinusoidal signal piggy-backed on top of the principal signal. In this example, the 30 Hz sine wave signal would act as the carrier signal for "carrying" the 90 Hz sine wave signal into the body. It is known that a lower frequency signal, such as 30 Hz signal, can more easily transmit through the body than a higher frequency signal. However, a higher frequency signal may be more suitable to treat the tissue once inside the body than the lower frequency signal.

The display 24 of the Device 10 can be used to inform the user of his or her progress, including providing other information, such as, for example, whether the user is well-balanced on the top plate assembly 12. To indicate whether the user is well-balanced, the display 24 can feature a virtual bubble level similar to a bubble level used by masons. If the virtual bubble is not at a specific location on the display 24, the user can adjust his or her position to move the virtual bubble to the specific location. In embodiments, the display 24 or a secondary display can be a hard-wired or wireless display, such as a display mounted to a wall, a display on a hand-held device, or other display. Other indicators for informing the user if he or she is well-balanced can include bars. If five bars, for example, are lit the user is well-balanced, compared to if one bar is lit.

A color scheme can also be used to inform the user if he or she is well-balanced. For example, a green light informs the user that he or she is perfectly balanced. An orange light informs the user that he or she is satisfactorily balanced. A red light informs the user that he or she is poorly balanced. In embodiments, the user can be informed of his or her balance by tonal cues. If the user is off balance the tonal cues get louder, which decrease in loudness or disappear as the user balances himself on Device 10. A message can also be displayed informing the user to adjust his or her weight, such as "Please adjust your weight," or "Please move your feet closer together and stand upright." Irrespective of whether the user is perfectly or poorly balanced on the top plate assembly 12 of the Device 10, in embodiments of the Device 10, the Device 10 is still able to vibrate the top plate assembly 12 at the predetermined magnitude, such as, for example, 0.3 g at 30 Hz, based on the design and method of operation of the Device 10 as further described below.

In embodiments, the Device 10 gives a user a predetermined amount of time to reposition to properly balance himself or herself on the top plate assembly 12. For example, after the user is notified of not being properly or satisfactorily balanced, the user is provided with 5 seconds to properly balance himself or herself. If the user does not properly balance himself or herself, the Device 10, then gives an error message, shuts off, sounds an alarm, and/or gives the user more time, such as, for example, an additional two seconds, before the Device 10 gives an error message, shuts off, and/or sounds an alarm.

The springs 16 are positioned as close as possible to the outer edge of the base plate assembly 14 to increase stability of the Device 10 without increasing the spring constant and making the Device 10 too stiff to be efficiently driven by a high fidelity actuator.

In embodiments, the springs 16 are removable and replaceable for customizing the overall Device 10 spring constant (Device 10 can be considered as one large spring) based on the weight and/or other factors/characteristics of the subject. For example, for a child subject, several of the springs 16 can be removed and/or replaced with springs 16 having a different spring constant than springs 16 ordinarily used for adult subjects. In an additional example, an adult subject that is obese will require springs 16 of a greater spring constant. In another example, a person in a rehabilitation facility that is only able to toe-touch to bear weight might require fewer springs 16 at first with additional springs 16 added later.

In embodiments, the present disclosure provides a business method where a company determines which springs are most suitable for a particular subject and ships the springs 16 to be fitted to a Device 10 to be used by the subject, or ships a new Device 10 fitted with the springs 16 determined to be most suitable to the subject.

The Device 10 further includes fins 26 on the inner surface of the top plate assembly 12 and/or the base plate assembly 14. The fins 26 function as heat sinks for the amplifier of the logic PCB assembly 22. The fins 26 further provide stiffness for the top plate assembly 12, allowing the top plate assembly 12 and the base plate assembly 14 to be stiff—as needed for effective transmissibility of the acceleration from the actuator 50 to the standing subject, but the entire Device 10 to be relatively light to maximize portability. The actuator mounting assembly 20 includes a mounting cup 30 configured and dimensioned for receiving therein the actuator support housing 18 and the actuator plate 19 mounted thereto. The actuator plate 19 is mounted to the actuator support housing 18 via screws, including guide screws 28 shown in FIG. 12. The actuator plate 19 makes direct contact with the inner surface of the top plate assembly 12 for transmitting the signal to the top plate assembly 12.

The actuator mounting assembly 20 further includes on an inner surface thereof a plurality of roller bearings 32 (see also FIG. 13) for preventing the actuator support housing 18 from contacting the inner surface of the mounting cup 30 when the top plate assembly 12 is not level with respect to the base plate assembly 14. For example, the subject standing on the top plate assembly 12 is poorly balanced due to distributing his or her weight to one side of the top plate assembly 12. This will cause the actuator support housing 18 to shift towards the inner surface of the mounting cup 30, perhaps, shift violently if the user is heavy. The roller bearings 32 prevent the actuator support housing 18 from violently striking the inner surface of the mounting cup 30 and possibly damaging the actuator 50 (an expensive part due to the solenoid coil therein) inside the actuator support housing 18. This design also protects the Device 10 during shipping, such as from impact of dropping a shipping box in transit, from the damage that arises from shear between the top plate assembly 12 and the base plate assembly 14. In the embodiment shown by the figures, the actuator mounting assembly 20 has four pairs of roller bearings 32 (see the top view of FIG. 2). The roller bearings 32 also assist in continuing to provide the LIV signal having a predetermined magnitude to the top plate assembly 12 even when the top plate assembly is not level with respect to the base plate assembly 14.

The top plate assembly 12 is positioned over the base plate assembly 14 as shown by FIGS. 1-7. The base plate assembly 14 includes four feet 34 (see also FIGS. 9A and 9B) for evenly resting the Device 10 on a surface, such as, for example, the floor. In embodiments, each foot 34 can be replaced with a foot assembly 34' which is designed to mechanically pivot or otherwise move for maintaining the top plate assembly 12 level with respect to the base plate assembly 14. Each foot assembly 34' can be designed to also be controllable by the controller 22 for maintaining the top plate assembly 12 level. Data regarding whether the top plate assembly 12 is level or not with respect to the base plate assembly 14 can be provided to the controller by a three-degree of freedom accelerometer PCB assembly 36 (see FIGS. 1-6). The accelerometer PCB assembly 36 includes a top plate assembly accelerometer and is mounted to the underside or inner surface of the top plate assembly 12 via mounting structure 13. The top plate assembly accelerometer PCB assembly 36 has additional functions as described herein below with respect to the operation of the Device 10 as described below.

The top plate accelerometer PCB assembly 36 can also be used to turn on the Device 10. For example, when the Device 10 is in sleep or idle mode, a user can step onto the top plate assembly 12 and the accelerometer PCB assembly 36 would detect motion of the top plate assembly 12 and signal to the logic PCB assembly 22 to turn on the Device 10 or switch to an operation mode. In embodiments, if a user accidentally hits or moves the top plate assembly 12, and the Device 10 turns on or switches to an operation mode, the Device 10 is programmed to switch to an idle or sleep mode, or shut off if no weight is detected after a predetermined amount of time, i.e., the accelerometer does not detect motion of the top plate assembly 12 after the initial accidental hit or contact by the user of the top plate assembly 12.

A limit bumper 38 (see also FIG. 15) is inserted in a respective dowel 40 (see FIGS. 1-6) near each corner of the Device 10 and configured to connect the top plate assembly 12 to the base plate assembly 14. Each limit bumper 38 is designed to move along the longitudinal axis of its respective dowel 40 when weight is placed on the top plate assembly 12.

In embodiments, the Device 10 can be powered by a battery pack or by plugging the Device 10 to an electrical outlet. An on/off switch 44 is provided on a side surface of the base plate assembly 14. An LED light 46 indicates that the Device 10 is on or off. A reset button 48 is provided for resetting the Device 10. Other inputs and outputs besides the Ethernet port 42 can be provided to the Device 10, including a flash memory drive port for receiving a flash memory drive therein.

Referring to FIGS. 1 and 2, in embodiments, the actuator 50 and associated mounting assembly 20, including the mounting cup 30, are positioned off-center, e.g., at origin O' of axes X', Y' and Z', with respect to the center C of the base plate assembly 14. The reason for such a design is to have the center of pressure of the foot, as representing the vector in the Z' direction parallel to the longitudinal axis of the subject, to be over the actuator 50. This enables the user to be well-balanced over the actuator 50 which provides the low magnitude signal (i.e., LIV signal), thus maximizing transmissibility of the top plate assembly 12 acceleration to the standing subject.

Operation of the Vibration Device

FIG. 16 is a schematic diagram for the control and power distribution 100 for the Device 10 of FIGS. 1-15. FIG. 16 illustrates the relationship between the power and control signals to the actuator solenoid coil, the amplifier, the accelerometer and the controller.

Referring to FIG. 16 in conjunction with FIGS. 1-15, the Device 10 operates using a closed loop acceleration feedback system design 100. In particular, the accelerometer of the accelerometer PCB assembly 36 has three degrees of freedom (X, Y and Z planes). Referring to FIG. 1, axes X, Y and Z have an origin O at the accelerometer of the accelerometer PCB assembly 36. The accelerometer 36 is also in operative communication with the controller for detecting movement of the top plate assembly 12 and determining whether the top plate assembly 12 is level with respect to the base plate assembly 14. The accelerometer 36 further detects acceleration of the top plate assembly 12 and transmits acceleration data to the controller (closed loop acceleration feedback system).

The controller 22 determines based on the top plate assembly 12 acceleration data whether to increase, decrease or maintain the same power, and thus the electrical signal delivered to the actuator 50 via the solenoid coil leads 50*a* and 50*b* in order to maintain the acceleration of the top plate assembly 12 at a predetermined average acceleration, e.g., 0.3 g peak-to-peak. This error signal thus provides a key means of ensuring that the desired dynamics of the prescribed acceleration are in fact delivered to the top plate assembly 12, in a high fidelity manner. This enables the ability to deliver complex, compound signals to the subject in a highly controlled fashion, while simultaneously providing information on balance, calibration, etc.

Referring particularly to FIG. 16, the closed loop acceleration feedback system and design 100 includes power supply 102 which supplies electrical power and frequency control to the solenoid coil of the actuator 50 via the coil leads 50*a* and 50*b*, thereby providing the oscillating vibratory force. That is, the actuator 50 converts the electrical input signal to the oscillating vibratory force. In one embodiment, the Device 10 and closed loop acceleration feedback system and design 100 may include an amplifier 52 to amplify the oscillating vibratory force which is transmitted to the top or foot plate assembly 12. Based on g-force measurements by the accelerometer 36 for the top or foot plate assembly 12 and g-force measurements by the actuator accelerometer 21 mounted between the actuator 50 and the actuator plate 19, the controller logic printed circuit board assembly 22 implemented by controller 120 determines the error signals by comparison of the g-force and frequency measurements, and determines whether to increase, decrease or maintain the electrical signal delivered to the actuator 50 via the power supply 102 in order to maintain the acceleration of the top or foot plate assembly 12 at a predetermined average acceleration. The phrases "top plate assembly" and "foot plate assembly" may be used interchangeably herein.

In one embodiment, the controller logic printed circuit board assembly 22 implemented by controller 120 receives foot plate level measurement readings 130 via axes X, Y, Z at origin O from the foot plate assembly 12 and returns adjustment signals via 130 to the foot plate assembly 12 to control the level of the foot plate assembly Based on the closed loop acceleration feedback system and design 100, it is not critical if the top plate assembly 12 is level or not (e.g., situated on an incline or subject is not properly positioned or well-balanced), the top plate assembly 12 can still be accelerated at the same predetermined, prescribed and desired acceleration as when the top plate assembly 12 is level. That is, the top plate assembly 12 and the base plate assembly 14 are said to be at "zero level position" At beginning of treatment, regardless of whether the top plate assembly 12 is level or not. The method of operation can be described as "acceleration-controlled delivery."

The acceleration of the top plate assembly 12 is continuously or intermittently monitored using the closed loop acceleration feedback system and the acceleration "error" data is provided to the controller to adjust power to the actuator 50, in real time (e.g., 500 Hz fidelity) to best ascribe to the control signal. Without closed-loop feedback, there is no way of actually knowing if the signal waveform, in terms of intensity or frequency, in terms of simple or compound, is in fact delivered to the top plate assembly 12.

Based on the comparison between error and control signal, it is determined whether to adjust the power delivered to the actuator 50 to keep the signal delivered to the top plate assembly 12 closer to the control signal as established by the error signal. The controller can determine to increase, decrease or maintain the same power delivered to the actuator 50.

In embodiments, the Device 10 can be provided with a tunable error signal control in order for a user to be able to tune or control the characteristics of the signal by controlling, for example, the fidelity/resolution of the amplifier or the sampling rate of the error signal.

In view of the foregoing description in view of FIGS. 1-16, it can be appreciated that the present disclosure relates in embodiment to a device 10 that includes a top plate assembly 12 defining an outer surface 12' for placement thereof a subject. A base plate assembly is mounted to the top plate assembly 12 in a manner which enables the top plate assembly 12 to move relative to the base plate assembly 14. At least one energy recovery member, e. g., spring 16, is mounted to the top plate assembly 12 and the base plate assembly 14. An actuator mounting assembly 20 is configured and dimensioned for receiving an actuator support housing 18. An actuator plate 19 is mounted to the actuator support housing 18 and contacts an inner surface 12" of the top plate assembly 12. An actuator 50 is housed within the actuator support housing 18 and is configured for transmitting a vibration signal represented by an oscillatory vibratory force to the top plate assembly 12 via the actuator plate 19. The actuator 50 converts an electrical input signal to the oscillating vibratory force. The Device 10 also includes a controller 22 and an accelerometer 36 having three degrees of freedom X, Y, Z at origin O and is in operative communication with the controller 22 for detecting movement of the top plate assembly 12 and determining whether the top plate assembly 12 is level with respect to the base plate assembly 14. The accelerometer 36 further detects acceleration of the top plate assembly 12 and transmits acceleration data to the controller 22.

The controller 22 determines based on the acceleration data whether to increase, decrease or maintain the electrical signal delivered to the actuator 50 in order to maintain the acceleration of the top plate assembly 12 at a predetermined average acceleration. In one embodiment, the controller 22 maintains the acceleration of the top plate assembly 12 at a predetermined average acceleration of 0.3 g peak-to-peak.

The present disclosure relates also to a base plate assembly 14 for an oscillating vibration device 10 that includes an actuator mounting assembly 20 configured to receive an actuator 50 generating a low intensity vibration signal. The actuator mounting assembly 20 includes an actuator support housing 18 and a mounting cup 30 configured and dimensioned for receiving therein the actuator support housing 18. The base plate assembly 14 defines a center C therein. The actuator mounting assembly 20 is positioned in the base plate assembly 14 at a position O' offset with respect to the center C defined by the base plate assembly 14. The position O' of the actuator mounting assembly 20 is generally aligned with the center C of pressure of the feet of a user of the oscillating vibration device 10.

In one exemplary embodiment, the base plate assembly 14 may further include an actuator 50 mounted within the mounting cup 30 and an actuator plate 19 mounted on the actuator support housing 18. The actuator 50 is configured and dimensioned for transmitting a vibration signal represented by an oscillating vibratory force to the actuator plate 19. The actuator 50 converts an electrical input signal to the oscillating vibratory force.

In still another exemplary embodiment, the base plate assembly 14 may further include a foot assembly 34' configured for operative communication with a foot plate assembly 12 of the oscillating vibration device. The foot plate assembly 12 defines a baseline level with respect to a surface 12' upon which the base plate assembly 14 is positioned. The foot assembly 34' includes at least one foot assembly actuator in signal communication with a controller 22 such that upon the controller 22 receiving a signal indicating that the foot plate assembly 12 is not aligned with the baseline level, the controller 22 transmits a signal to the at least one foot assembly actuator to adjust the position of the foot plate assembly 12 to align with the baseline level.

In yet another exemplary embodiment, the base plate assembly 14 may further include at least one energy recovery member, e.g., springs 16, that is configured and disposed to transmit and receive forces imposed on the one or more energy recovery members 16 by the foot plate assembly 12.

In still a further exemplary embodiment, the base plate assembly 14 may further include an accelerometer 36 operatively connected to the actuator plate 19. The accelerometer has three degrees of freedom X, Y, Z and is in operative communication with controller 22 for detecting movement transmitted by the actuator plate 19 to foot plate assembly 12 of the oscillating vibration device 10. The accelerometer 36 further detects acceleration of the foot plate assembly 12 and transmits acceleration data to the controller 22.

In one exemplary embodiment, the base plate assembly 14 further includes controller 22, wherein the controller determines based on the acceleration data whether to increase, decrease or maintain the electrical signal delivered to the actuator 50 to control the oscillating vibratory force in order to maintain the acceleration of the top plate assembly 12 at a predetermined average acceleration. In one exemplary embodiment, the predetermined average acceleration is 0.3 g peak-to-peak.

In still another exemplary embodiment, the base plate assembly 14 may further include foot plate assembly 12. The foot plate assembly 12 defines a cavity 27 therein configured and dimensioned to receive the actuator plate 19 such that the actuator plate 19 is in direct contact with the foot plate assembly 12, the actuator plate 19 transmitting thereby the vibration signal represented by an oscillating vibratory force to the foot plate assembly 12.

In a still further exemplary embodiment, the base plate assembly 14 may further include an amplifier 52. The amplifier 52 is in operative communication with the actuator 50 to amplify the vibration signal represented by an oscillating vibratory force to the actuator plate 19.

The present disclosure relates also to a top plate assembly 12 for oscillating vibration device 10. The top plate assembly 12 defines cavity 27 therein configured and dimensioned to receive actuator plate 19 such that the actuator plate 19 is in direct contact with the top plate assembly 12. The actuator plate 19 transmits thereby a vibration signal represented by an oscillating vibratory force to the top plate assembly 12 to operate the oscillating vibration device.

In one exemplary embodiment, the top plate assembly 12 may further include base plate assembly 14 for oscillating vibration device 10. The top plate assembly 12 is configured and dimensioned to be mounted on the base plate assembly 14. The base plate assembly 14 includes actuator mounting assembly 20 configured to receive actuator 50 generating a vibration signal represented by an oscillating vibratory force.

The actuator mounting assembly 20 includes an actuator support housing 18 and a mounting cup 30 configured and dimensioned for receiving therein the actuator support housing 18. The base plate assembly 14 defines a center C therein. The actuator mounting assembly 20 is positioned in the base plate assembly 14 at a position O' offset with respect to the center C defined by the base plate assembly 14. The position O' of the actuator mounting assembly 20 is generally aligned with the center C of pressure of the feet of a user of the oscillating vibration device 10.

In one exemplary embodiment, the top plate assembly 12 may further include an actuator 50 mounted within the mounting cup 30 and an actuator plate 19 mounted on the actuator support housing 18. The actuator 50 is configured and dimensioned for transmitting a vibration signal represented by an oscillating vibratory force to the actuator plate 19. The actuator 50 converts an electrical input signal to the oscillating vibratory force.

In still another exemplary embodiment, the top plate assembly 12 may further include a foot assembly 34' configured for operative communication with a foot plate assembly 12 of the oscillating vibration device. The top or foot plate assembly 12 defines a baseline level with respect to an outer surface 12' upon which the top or foot plate assembly 12 is positioned. The foot assembly 34' includes at least one foot assembly actuator in signal communication with a controller 22 such that upon the controller 22 receiving a signal indicating that the top or foot plate assembly 12 is not aligned with the baseline level, the controller 22 transmits a signal to the at least one foot assembly actuator to adjust the position of the top or foot plate assembly 12 to align with the baseline level.

In yet another exemplary embodiment, the top plate assembly 12 may further include at least one energy recovery member, e.g., springs 16, that is configured and disposed to transmit and receive forces imposed on the one or more energy recovery members 16 by the foot plate assembly 12.

In still a further exemplary embodiment, the top plate assembly 12 may further include an accelerometer 36 operatively connected to the actuator plate 19. The accelerometer has three degrees of freedom X, Y, Z and is in operative communication with controller 22 for detecting movement transmitted by the actuator plate 19 to foot plate assembly 12 of the oscillating vibration device 10. The accelerometer 36 further detects acceleration of the foot plate assembly 12 and transmits acceleration data to the controller 22.

In one exemplary embodiment, the top plate assembly 12 further includes controller 22, wherein the controller determines based on the acceleration data whether to increase, decrease or maintain the electrical signal delivered to the actuator 50 to control the oscillating vibratory force in order to maintain the acceleration of the top plate assembly 12 at a predetermined average acceleration. In one exemplary embodiment, the predetermined average acceleration is 0.3 g peak-to-peak.

In still another exemplary embodiment, the top plate assembly 12 may further include foot plate assembly 12. The foot plate assembly 12 defines a cavity 27 therein configured and dimensioned to receive the actuator plate 19 such that the actuator plate 19 is in direct contact with the foot plate assembly 12, the actuator plate 19 transmitting thereby the vibration signal represented by an oscillating vibratory force to the foot plate assembly 12.

In a still further exemplary embodiment, the top plate assembly 12 may further include an amplifier 52. The amplifier 52 is in operative communication with the actuator 50 to amplify the vibration signal represented by an oscillating vibratory force to the actuator plate 19.

The present disclosure relates also to a vibration device 10 that includes top plate assembly 12 defining cavity 27 therein that is configured and dimensioned to receive actuator plate 19 such that the actuator plate 19 is in direct contact with the top plate assembly 12. The actuator plate 19 transmits thereby a vibration signal represented by an oscillating vibratory force to the top plate assembly 12 to operate the oscillating vibration device.

In one embodiment, the vibration device 10 further includes base plate assembly 14 for the vibration device 10. The top plate assembly 12 is configured and dimensioned to be mounted on the base plate assembly 14. The base plate assembly 14 includes actuator mounting assembly 20 that is configured to receive actuator 50 generating a vibration signal represented by an oscillating vibratory force, The actuator mounting assembly 20 includes an actuator support housing 18 and a mounting cup 30 configured and dimensioned for receiving therein the actuator support housing 18. The base plate assembly 14 defines a center C therein. The actuator mounting assembly 20 is positioned in the base plate assembly 14 at a position O' offset with respect to the center C defined by the base plate assembly 14. The position O' of the actuator mounting assembly 20 is generally aligned with the center C of pressure of the feet of a user of the oscillating vibration device 10.

In one exemplary embodiment, the oscillating vibration device 10 may further include an actuator 50 mounted within the mounting cup 30 and an actuator plate 19 mounted on the actuator support housing 18. The actuator 50 is configured and dimensioned for transmitting a vibration signal represented by an oscillating vibratory force to the actuator plate 19. The actuator 50 converts an electrical input signal to the oscillating vibratory force.

In still another exemplary embodiment, the oscillating vibration device 10 may further include a foot assembly 34' configured for operative communication with a foot plate assembly 12 of the oscillating vibration device. The foot plate assembly 12 defines a baseline level with respect to a surface 12' upon which the oscillating vibration device 10 is positioned. The foot assembly 34' includes at least one foot assembly actuator in signal communication with a controller 22 such that upon the controller 22 receiving a signal indicating that the foot plate assembly 12 is not aligned with the baseline level, the controller 22 transmits a signal to the at least one foot assembly actuator to adjust the position of the foot plate assembly 12 to align with the baseline level.

In yet another exemplary embodiment, the oscillating vibration device 10 may further include at least one energy recovery member, e.g., springs 16, that is configured and disposed to transmit and receive forces imposed on the one or more energy recovery members 16 by the foot plate assembly 12.

In still a further exemplary embodiment, the oscillating vibration device 10 may further include an accelerometer 36 operatively connected to the actuator plate 19. The accelerometer has three degrees of freedom X, Y, Z and is in operative communication with controller 22 for detecting movement transmitted by the actuator plate 19 to foot plate assembly 12 of the oscillating vibration device 10. The accelerometer 36 further detects acceleration of the foot plate assembly 12 and transmits acceleration data to the controller 22.

In one exemplary embodiment, the oscillating vibration device 10 further includes controller 22, wherein the controller determines based on the acceleration data whether to increase, decrease or maintain the electrical signal delivered to the actuator 50 to control the oscillating vibratory force in order to maintain the acceleration of the oscillating vibration device 10 at a predetermined average acceleration. In one exemplary embodiment, the predetermined average acceleration is 0.3 g peak-to-peak.

In still another exemplary embodiment, the oscillating vibration device 10 may further include foot plate assembly 12. The foot plate assembly 12 defines a cavity 27 therein configured and dimensioned to receive the actuator plate 19 such that the actuator plate 19 is in direct contact with the foot plate assembly 12, the actuator plate 19 transmitting thereby the vibration signal represented by an oscillating vibratory force to the foot plate assembly 12.

In a still further exemplary embodiment, the oscillating vibration device 10 may further include an amplifier 52. The amplifier 52 is in operative communication with the actuator 50 to amplify the vibration signal represented by an oscillating vibratory force to the actuator plate 19.

Still further, the present disclosure relates to a method of operating oscillating vibration device 10 that includes transmitting a vibration signal represented by an oscillating vibratory force to top or foot plate assembly 12 of the oscillating vibration device 10, measuring via accelerometer 36 having three degrees of freedom X, Y, Z acceleration of the top or foot plate assembly 12 and transmitting acceleration data to controller 22, determining via the controller 22 based on the acceleration data whether to increase, decrease or maintain the electrical signal delivered to the actuator 50 in order to maintain the acceleration of the top or foot plate assembly 12 at a predetermined average acceleration.

In one exemplary embodiment, maintaining the acceleration of the top plate assembly 12 at a predetermined average acceleration may include maintaining the acceleration of the top plate assembly 12 at a predetermined average acceleration of 0.3 g peak-to-peak.

The method may further include, wherein the foot plate assembly 12 defines a baseline level with respect to a surface upon which the oscillating vibration device 10 is positioned, upon the controller 22 receiving a signal indicating that the foot plate assembly 12 is not aligned with the baseline level, the controller 22 transmitting a signal to at least one foot assembly actuator to adjust the position of the foot plate assembly 34' to align with the baseline level.

Although the present disclosure has been described in considerable detail with reference to certain preferred version thereof, other versions are possible and contemplated. Therefore, the spirit and scope of the appended claims should not be limited to the description of the preferred versions contained therein.

Any element in a claim that does not explicitly state "means for" performing a specified function or "step for" performing a specified function, is not to be interpreted as a "means" or "step" clause as specified in 35 U.S.C. § 112, ¶6. In particular, the use of "step of" in the claims is not intended to invoke the provisions of 35 U.S.C. § 112, ¶6.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope of the claims appended hereto.

In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The embodiments of the present disclosure may be implemented by means of hardware comprising several distinct elements, and/or by means of a suitably programmed processor. In the device claim enumerating several means, several of these means may be embodied by one and the same item of hardware. The mere fact that certain measures are recited in mutually different dependent claims does not indicate that a combination of these measures cannot be used to advantage.

What is claimed is:

1. A device comprising:

a foot plate assembly defining an outer surface and an inner surface, the foot plate assembly defining a baseline level with respect to a surface upon which the device is configured to be positioned;

a base plate assembly mounted to the foot plate assembly in a manner which enables the foot plate assembly to move relative to the base plate assembly;

at least one spring mounted to the foot plate assembly and the base plate assembly;

an actuator support housing;

an actuator mounting assembly configured for receiving the actuator support housing;

an actuator plate mounted to the actuator support housing and contacting the inner surface of the foot plate assembly;

an actuator housed within the actuator support housing and configured for transmitting a vibration signal represented by an oscillatory vibratory force to the foot plate assembly via the actuator plate, the actuator configured for converting an electrical input signal to the oscillating vibratory force;

a controller; and an accelerometer having three degrees of freedom and in operative communication with the controller for detecting movement of the foot plate assembly and determining whether the foot plate assembly is level with respect to the base plate assembly, the accelerometer further configured for detecting acceleration of the foot plate assembly and transmitting acceleration data to the controller;

wherein the controller is configured for determining, based on the acceleration data, whether to increase, decrease or maintain the electrical signal delivered to the actuator in order to maintain the acceleration of the foot plate assembly at a predetermined average acceleration, wherein upon the controller receiving a signal indicating that the foot plate assembly is not aligned with the baseline level, the controller configured for transmitting a signal to at least one foot assembly to adjust a position of the foot plate assembly to align with the baseline level, the at least one foot assembly extending below a bottom surface of the base plate assembly to support the base plate assembly above an underlying surface below the bottom surface of the base plate assembly.

2. The device according to claim 1, wherein the controller maintains the acceleration of the foot plate assembly at a predetermined average acceleration of 0.3 g peak-to-peak.

3. A method of operating an oscillating vibration device comprising:

providing an oscillating vibration device having a foot plate assembly defining an outer surface and an inner surface, a base plate assembly mounted to the foot plate assembly, an actuator support housing, an actuator mounting assembly configured for receiving the actuator support housing, an actuator plate mounted to the actuator support housing and contacting the inner surface of the foot plate assembly, and an actuator housed within the actuator support housing;

transmitting, by the actuator, a vibration signal represented by an oscillating vibratory force to the foot plate assembly, the foot plate assembly defining a baseline level with respect to a surface upon which the oscillating vibration device is configured to be positioned;

measuring, via an accelerometer having three degrees of freedom X, Y, Z, acceleration of the foot plate assembly and transmitting acceleration data to a controller; and determining via the controller, based on the acceleration data, whether to increase, decrease or maintain the electrical signal delivered to the actuator in order to maintain the acceleration of the foot plate assembly at a predetermined average acceleration, wherein upon the controller further receiving a signal, from the accelerometer, indicating that the foot plate assembly is not aligned with the baseline level, the controller transmitting a signal to at least one foot assembly of the oscillating vibration device to adjust a position of the foot plate assembly to align with the baseline level, the at least one foot assembly extending below a bottom surface of the base plate assembly to apply pressure to an underlying surface below the bottom surface of the base plate assembly to adjust the position of the foot plate assembly.

4. The method according to claim 3, wherein maintaining the acceleration of the foot plate assembly at a predetermined average acceleration includes maintaining the acceleration of the foot plate assembly at a predetermined average acceleration of 0.3 g peak-to-peak.

* * * * *